US011180284B2

(12) United States Patent
Longo

(10) Patent No.: US 11,180,284 B2
(45) Date of Patent: Nov. 23, 2021

(54) MULTI-COMPARTMENT CONTAINER SYSTEM WITH DETACHABLE AND RE-ATTACHABLE COMPARTMENTS AND METHODS AND SYSTEMS OF USING THE SAME

(71) Applicant: Stephen Michael Longo, West Orange, NJ (US)

(72) Inventor: Stephen Michael Longo, West Orange, NJ (US)

( * ) Notice: Subject to any disclaimer, the term of this patent is extended or adjusted under 35 U.S.C. 154(b) by 200 days.

(21) Appl. No.: 16/549,281

(22) Filed: Aug. 23, 2019

(65) Prior Publication Data

US 2020/0277105 A1 Sep. 3, 2020

Related U.S. Application Data

(60) Provisional application No. 62/812,937, filed on Mar. 1, 2019.

(51) Int. Cl.

| | |
|---|---|
| ***B65D 21/024*** | (2006.01) |
| ***B65D 25/06*** | (2006.01) |
| ***B65D 43/02*** | (2006.01) |
| ***B65D 21/02*** | (2006.01) |
| ***B65D 25/20*** | (2006.01) |

(52) U.S. Cl.
CPC ..... *B65D 25/06* (2013.01); *B65D 21/0204* (2013.01); *B65D 25/20* (2013.01); *B65D 43/0202* (2013.01); *B65D 2543/00018* (2013.01); *B65D 2543/00953* (2013.01)

(58) Field of Classification Search
CPC ..... B65D 21/0204; B65D 21/0201; B65D 43/0202; B65D 25/06; B65D 25/20
USPC ..... 220/23.4
See application file for complete search history.

(56) References Cited

U.S. PATENT DOCUMENTS 4,300,700 A * 11/1981 Chang ..... B65D 43/0204 220/212
4,303,732 A * 12/1981 Torobin ..... C04B 20/1055 428/333
5,890,613 A * 4/1999 Williams ..... A45C 7/0045 220/23.4
6,244,458 B1 * 6/2001 Frysinger ..... B65D 81/3823 220/592.09

(Continued)

*Primary Examiner* — Stephen J Castellano
(74) *Attorney, Agent, or Firm* — Lucas & Mercanti, LLP

(57) ABSTRACT

A multi-compartment container system includes a plurality of compartments. Each compartment includes a cup portion comprising a volume adapted to hold a food or liquid, and a frame portion joined to the cup portion. The frame portion surrounds a top portion or edge of the cup portion, and includes a connector element disposed on a side of the frame and one or more first mating elements. The compartment also includes a lid having one or more second mating elements adapted to engage with the one or more first mating elements of the frame to form a seal, and a chamber adapted to hold a utensil. The connector element of the frame is joined to an adjacent connector element of an adjacent frame of an adjacent compartment. The cup portion includes a first section and a second section, and the cup portion is adapted to move between an expanded state in which no part of the second section is inside the first section and a collapsed state in which at least a portion of the second section is inside the first section.

15 Claims, 21 Drawing Sheets

(56) References Cited

U.S. PATENT DOCUMENTS

| | | | | |
|---|---|---|---|---|
| 6,371,321 | B1 * | 4/2002 | Lee | B65D 21/0204 220/23.4 |
| 2015/0253055 | A1 * | 9/2015 | Tsui | B62B 5/066 62/62 |

* cited by examiner

MULTI-COMPARTMENT CONTAINER SYSTEM WITH DETACHABLE AND RE-ATTACHABLE COMPARTMENTS AND METHODS AND SYSTEMS OF USING THE SAME

CROSS REFERENCE TO RELATED APPLICATION

This Application claims the benefit of priority of U.S. Provisional Application No. 62/812,937, filed Mar. 1, 2019, which is incorporated herein by reference.

TECHNICAL FIELD

The present application relates generally to containers, and more particularly, to a collapsible multi-compartment container system with detachable and re-attachable compartments and methods and systems of using the same.

BACKGROUND

Containers (or vessels) of many types, sizes and forms for receiving and storing food and liquid goods are known. Many containers have multiple compartments which allow the separation of different foods and/or liquids into different compartments within a single container.

Multi-compartment containers are often designed with compartments that are easily detachable from one another. For example, in many multi-compartment containers, the compartments are connected by a weakened portion with a perforated or bendable line that allows a user easily to separate a compartment from the others. Other multi-compartment containers include an underlying structure and a number of smaller compartments that fit within the structure; typically, the compartments can be removed from the underlying structure and then placed back in their original positions.

Existing containers, such as those described above, tend to suffer from several drawbacks. For example, the inclusion of a weakened portion in the connecting section between compartments often results in a low structural rigidity in the connecting section, which can cause several problems. For example, compartments in such a container sometimes separate when in storage, when being transported, when being held by a user, or at other times. Also, after a compartment has been detached along the weakened portion, the compartment cannot be re-attached.

Another problem associated with existing containers is the lack of a collapsible function. As a result, existing containers cannot be efficiently stored and/or transported when empty.

Another problem associated with existing container systems is that some container systems include smaller compartments within a larger unit. In these container systems, the compartment volumes are fixed. A user is therefore limited to using the existing compartments and volumes.

SUMMARY

There is a need for a collapsible multi-compartment container having compartments that are detachable from one another and re-attachable to one another, and are connected by connecting sections that are convenient and easy to use and have a structural rigidity that is sufficient to prevent unwanted separation of the compartments from one another (for example, when only one or a subset of the compartments are supported by a user's hand). There is also a need for a container system in which compartments are interchangeable, providing a user the ability to optimize his or her control over portion sizes by mixing and matching compartments of different volume capacities.

In accordance with an embodiment, a multi-compartment container includes detachable compartments and a collapsibility function. The compartments are connected by connecting sections having a high structural rigidity. The compartments are adapted to maintain different temperatures, so that some compartments may hold heated foods or liquids while other compartments may hold cold foods or liquids. The collapsibility function facilitates easy storage and carrying.

In accordance with an embodiment, a multi-compartment container system includes a plurality of compartments. Each compartment includes a cup portion comprising a volume adapted to hold a food or liquid, and a frame portion joined to the cup portion. The frame portion surrounds a top portion and/or edge of the cup portion, and includes a connector element disposed on a side of the frame that enables attachment to another compartment, and one or more first mating elements that enable the attachment of a lid or cover. The compartment also includes a lid having one or more second mating elements adapted to engage with the one or more first mating elements of the frame to form a seal, and a chamber adapted to hold a utensil. The connector element of the frame is joined to an adjacent connector element of an adjacent frame of an adjacent compartment.

In various embodiments, the volume capacity of the compartments of a container system may vary. The volume capacity of the compartments is not fixed to the design and allows a user greater flexibility in portion control.

In one embodiment, the cup portion further includes a first section and a second section. The cup portion is adapted to move between an expanded state in which no part of the second section is inside the first section and a collapsed state in which at least a portion of the second section is inside the first section.

In another embodiment, the cup portion further includes a flexible section adapted to move between an extended condition and a compressed condition. The cup portion is in the expanded state when the flexible section is in the extended condition, and the cup portion is in the collapsed state when the flexible section is in the compressed condition.

In another embodiment, the cup portion further includes a flexible section adapted to move between an extended condition and a bent condition. The cup portion is in the expanded state when the flexible section is in the extended condition, and the cup portion is in the collapsed state when the flexible section is in the bent condition.

In another embodiment, the frame includes a top surface, and the cup portion includes a top section and a bottom section. The bottom section has a bottom surface. The top surface and the bottom surface are separated by a first distance when the cup portion is in the expanded state, and the top surface and the bottom surface are separated by a second distance when the cup portion is in the collapsed state, wherein the second distance is less than one-half the first distance.

In another embodiment, at least one of the cup portion, the frame portion, and the lid comprises silicone. For example, one or more components of a compartment, or one or more components of a container system, may be made from 100% food-grade silicone. Advantageously, silicone has natural insulating properties. Other materials may be used, such as, without limitation, metal, plastic, rubber, etc.

In another embodiment, at least one of the cup portion, the frame portion, and the lid comprises glass microspheres.

In another embodiment, the connector element includes a cavity and the adjacent connector element comprises a projecting element adapted to fit into the cavity.

In another embodiment, the cavity includes a first region having a first width and a second region having a second width smaller than the first width. The projecting element includes a sliding portion having a third width smaller than the first width and larger than the second width. The sliding portion is adapted to fit into and slide within the first region, and the sliding portion is blocked by and cannot slide within the second region.

In another embodiment, the connector element further includes a blocking element disposed in the second region that reduces a width of the cavity. The projecting element further includes a notch. At least a portion of the blocking element fits into the notch.

In another embodiment, the first mating element includes a projecting element and the second mating element includes a groove adapted to receive the projecting element.

In another embodiment, the utensil is a spork, a fork, a spoon, a knife, a straw, or chopsticks.

In another embodiment, the lid further includes a cover adapted to cover the chamber and enclose the utensil.

In another embodiment, a multi-compartment container system includes a first compartment that includes a first cup portion comprising a first volume adapted to hold a first food or first liquid and a first frame portion joined to the first cup portion. The first frame portion surrounds a first top edge of the first cup portion, and includes a first connector element disposed on a first side of the first frame, and one or more first mating elements. The container system also includes a first lid which has one or more second mating elements adapted to engage with the one or more first mating elements of the first frame to form a first seal, and a first chamber adapted to hold a first utensil. The container system also includes a second compartment connected to the first compartment. The second compartment includes a second cup portion comprising a second volume adapted to hold a second food or second liquid, and a second frame portion joined to the second cup portion. The second frame portion surrounds a second top edge of the second cup portion. The second frame portion includes a second connector element disposed on a second side of the second frame and connected to the first connector element of the first frame of the first compartment. The second frame also includes one or more third mating elements. The container system also includes a second lid having one or more fourth mating elements adapted to engage with the one or more third mating elements of the second frame to form a second seal, and a second chamber adapted to hold a second utensil.

In another embodiment, the first cup portion further includes a first section and a second section, and the first cup portion is adapted to move between an expanded state in which no part of the second section is inside the first section and a collapsed state in which at least a portion of the second section is inside the first section.

In another embodiment, at least one of the first cup portion, the first frame portion, and the first lid includes silicone.

In another embodiment, at least one of the first cup portion, the first frame portion, and the first lid includes glass microspheres.

In another embodiment, the first connector element includes a cavity and the second connector element comprises a projecting element adapted to fit into the cavity.

BRIEF DESCRIPTION OF THE DRAWINGS

Other objects, advantages and features will become more apparent upon reading the following non-restrictive description of embodiments thereof, given for the purpose of exemplification only, with reference to the accompanying drawings in which.

DETAILED DESCRIPTION

In the following description, the same numerical references refer to similar elements. The embodiments, geometrical configurations, materials mentioned and/or dimensions shown in the figures or described in the present description are embodiments only, given solely for exemplification purposes.

Moreover, although the embodiments of the multi-compartment container and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation therein between, as well as other suitable geometrical configurations, may be used for the multi-compartment container, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

Figure 1:
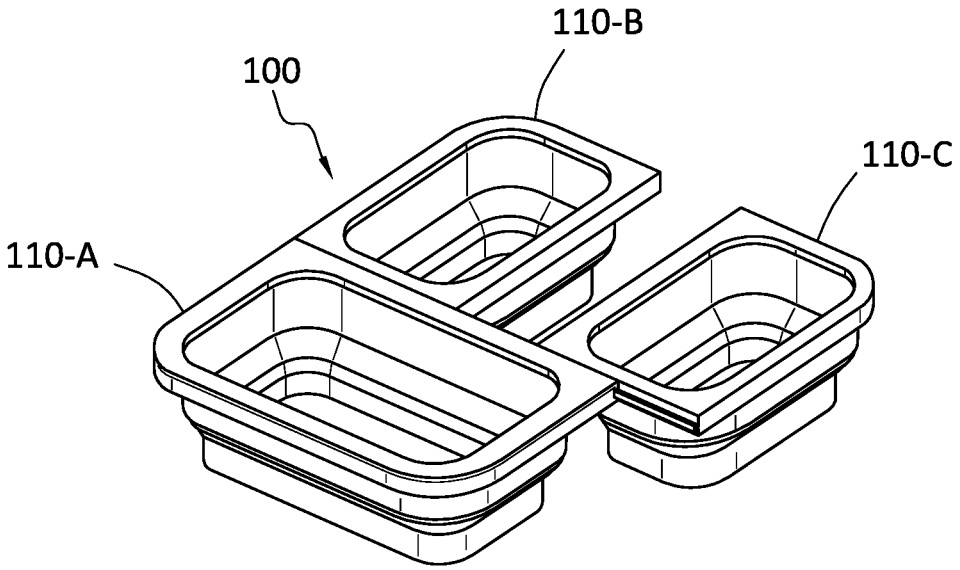
FIGS. 1-4 show a collapsible container system in accordance with an embodiment.
Figure 2:
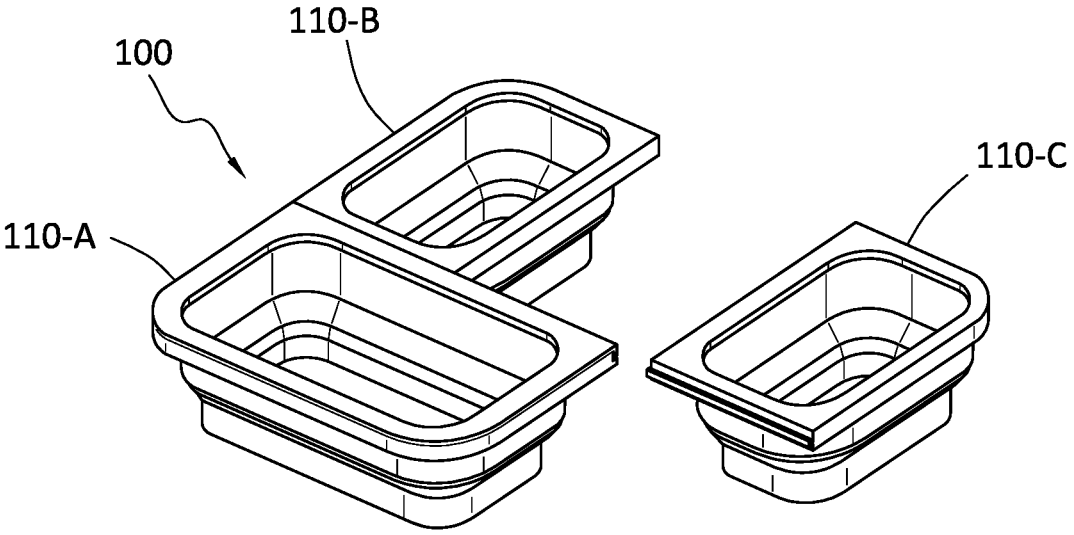
Figure 3:
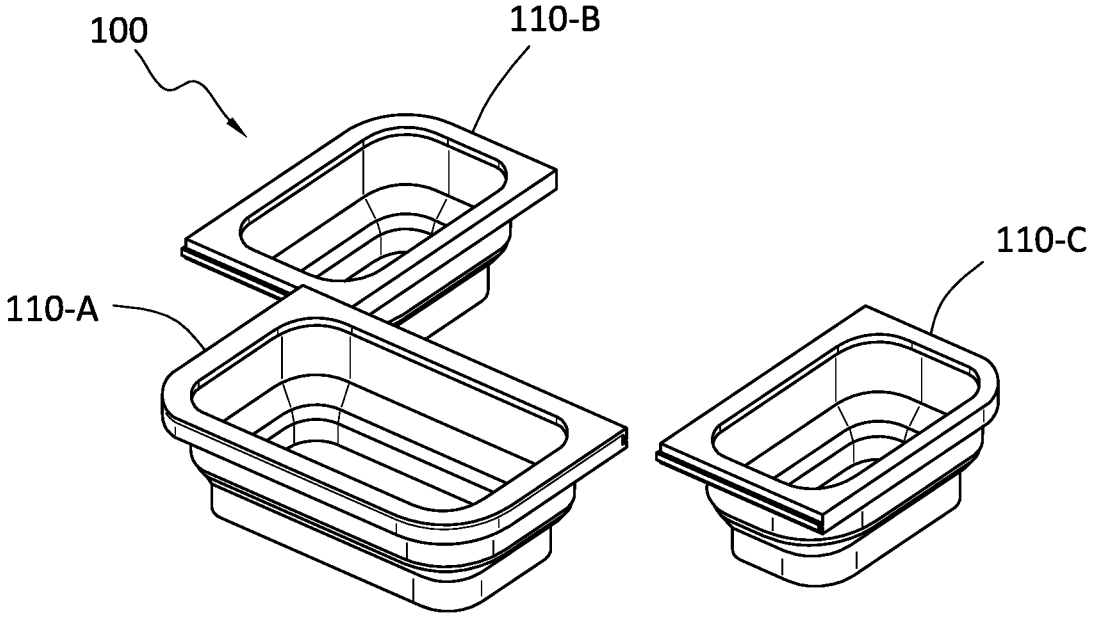
Figure 4:
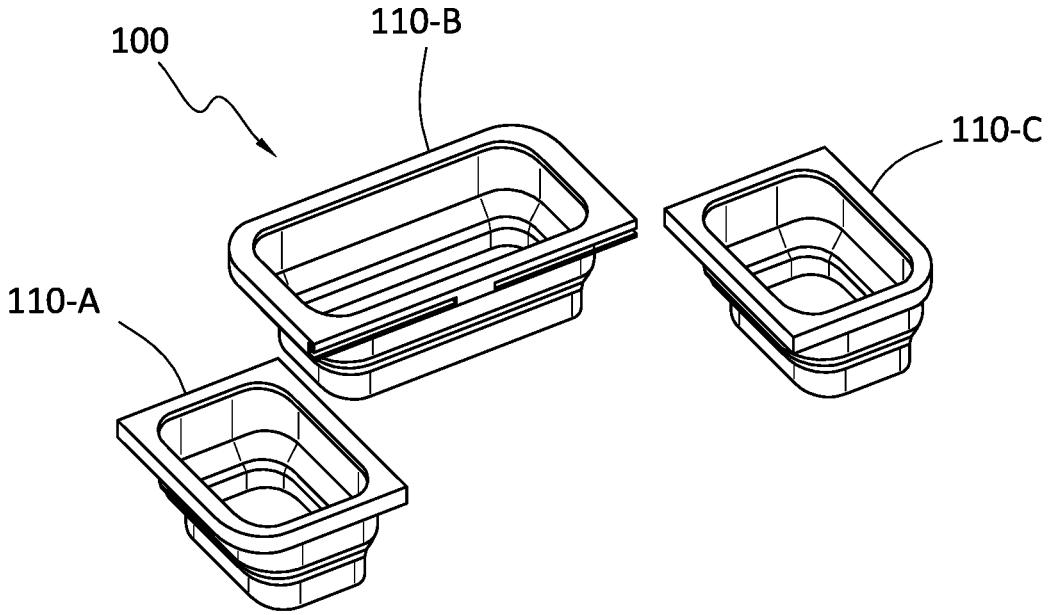

FIGS. 1-4 show a collapsible multi-compartment container system in accordance with an embodiment. Multi-compartment container system 100 includes a plurality of compartments 110-A, 110-B, and 110-C. While a multi-compartment container system having three compartments is shown in the illustrative embodiment, in other embodiments a multi-compartment container system may include more or fewer than three compartments. In the illustrative embodiment, compartments 110-A, 110-B, and 110-C fit together to form a multi-compartment container system, as shown in FIG. 1. Compartments 110-A, 110-B, 110-C may be detached from each other separately. FIG. 2 shows multi-compartment container system 100 after compartment 110-C has been detached. FIG. 3 shows multi-compartment container system 100 with compartment 110-C fully detached and compartment 110-B partially detached from container 110-A in accordance with an embodiment. FIG. 4 shows compartments 110-A, 110-B, 110-C entirely detached from one another.

Figure 5:
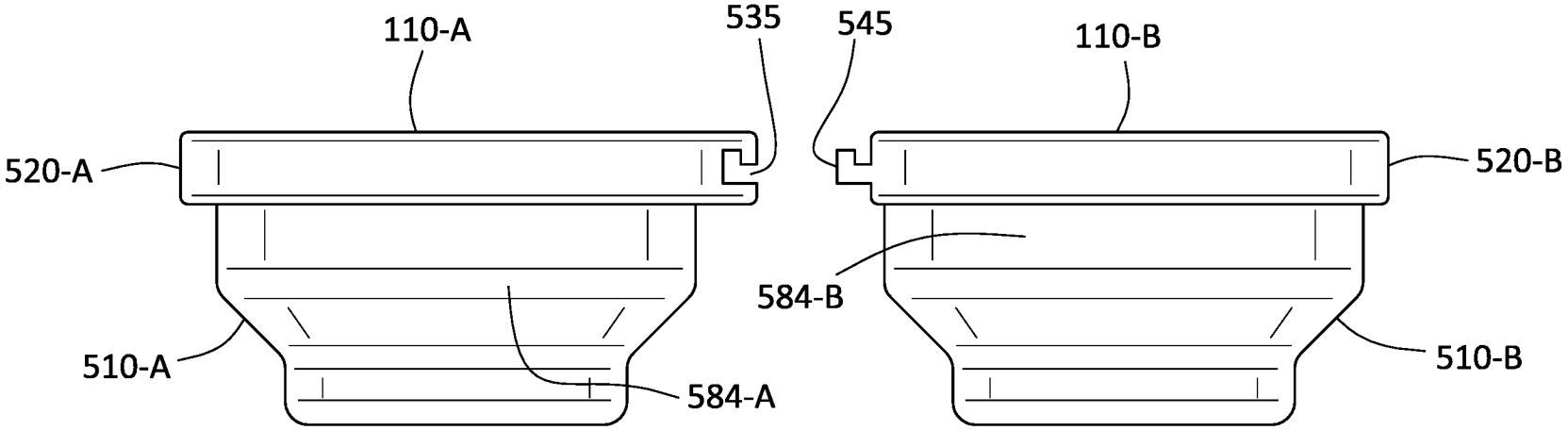
FIG. 5 shows a cross-section of two compartments of a multi-compartment container system in accordance with an embodiment.

FIG. 5 shows a cross-section of compartments 110-A and 110-B in accordance with an embodiment. Each compartment includes a cup portion 510 and a frame portion 520. The cup portion has a volume 584 adapted to hold a food or liquid. The frame portion is attached to the top portion of the cup portion and forms a rigid structure surrounding the top portion or top edge of the cup portion. The frame portion of one compartment is attached to the frame portion of at least one other compartment. Thus, compartment 110-A includes cup portion 510-A (having volume 584-A) and frame portion 520-A, and compartment 110-B includes cup portion 510-B (having volume 584-B) and frame portion 520-B. Cup portion 510 is formed of a flexible membrane having a first structural rigidity measure. For example, cup portion may be formed wholly or partly of silicone. Frame portion 520 is formed of a selected material having a second structural rigidity measure higher than the first structural rigidity measure. For example, frame portion 520 may be formed of silicone.

In one embodiment, a compartment has a width of 4 inches and a length of 6 inches. In other embodiments, any width and any length may be used. For example, in other embodiments, a compartment may have a length between 4 and 8 inches and a width between 3 and 6 inches.

In accordance with an embodiment, the frame portion of each compartment of a container system includes at least one first connector element that is adapted to be connected to a second connector element of another compartment. In the illustrative embodiment of FIG. 5, compartment 110-A includes a connector element comprising a cavity 535, disposed in one side of frame 520-A. Compartment 110-B includes a connector element 545 disposed in one side of frame 520-B. Connector element 545 is adapted to fit into cavity 535; when connector element 545 is engaged with cavity 535, a strong joint is formed between the two compartments.

In one embodiment connector element 535 extends along an entire length of a side of frame 520-A. Similarly, connector element 545 extends along an entire length of a side of frame 520-B. Advantageously, because each connector element extends along the entire side of the frame of a respective compartment, the joint between the two connector elements is particularly strong.

In another embodiment, a connector element may extend along the entire periphery of a frame of a compartment (for example, along the entire length of each of four sides of the frame). In another embodiment, the length of a connector element is smaller than the length of a side of a frame; thus, the connector element does not extend the entire length of the side of the frame.

While a connector system that uses a connector and a cavity is illustrated in FIG. 5, in other embodiments, other types of connector systems may be used.

While in the illustrative embodiment, each compartment 110-A, 110-B has a connector element on only one side, in other embodiments, a compartment may have connector elements on more than one side.

Figure 6:
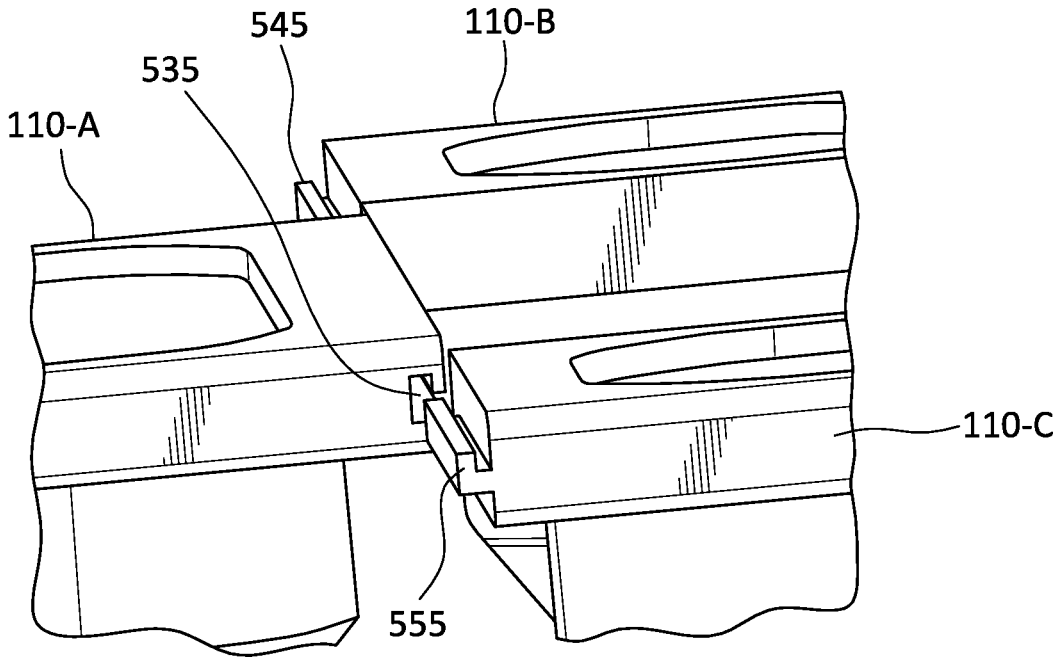
FIG. 6 shows a process of joining together several compartments of a multi-compartment container system in accordance with an embodiment.
Figure 7:
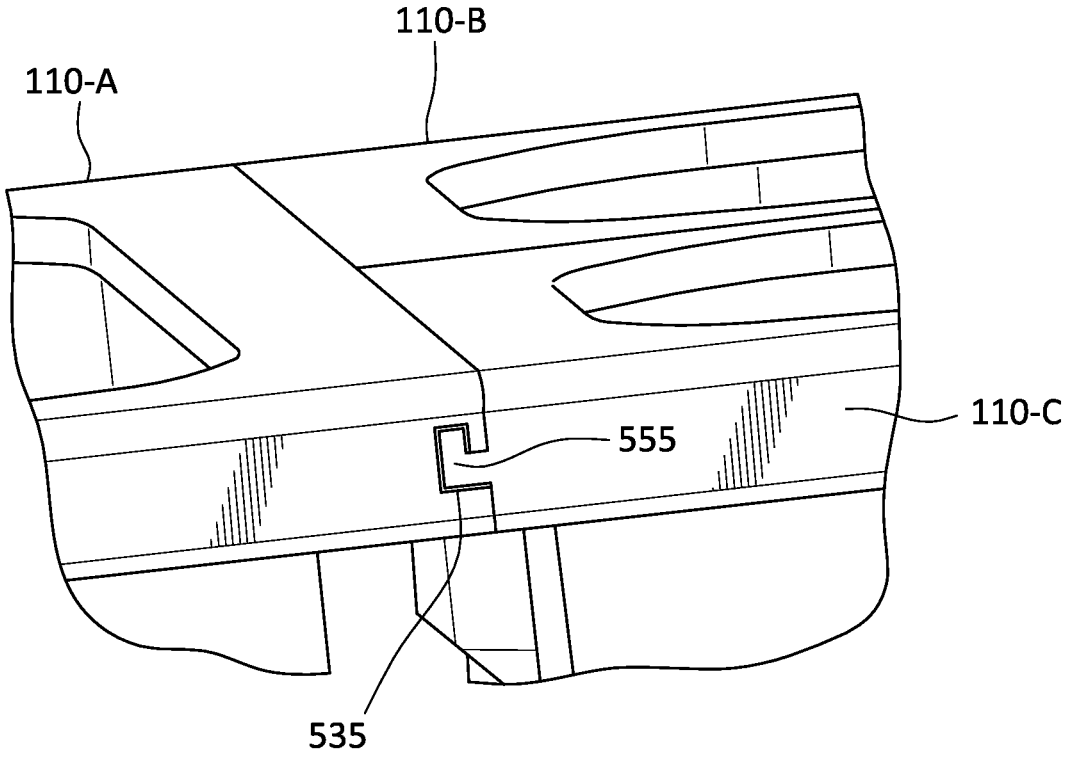
FIG. 7 shows several compartments joined together to form a container in accordance with an embodiment.

FIG. 6 shows a process of joining compartments 110-A, 110-B, 110-C together in accordance with an embodiment. Connector element 545 of compartment 110-B slides laterally into cavity 535 of compartment 110-A, from a first side of compartment 110-A. Similarly, connector element 555 of compartment 110-C slides laterally into cavity 535 of compartment 110-A, from a second side of compartment 110-A. FIG. 7 shows compartments 110-A, 110-B, 110-C joined together to form a multi-compartment container in accordance with an embodiment. Connector element 555, and connector 545 (not shown in FIG. 7), are engaged in cavity 535.

In other embodiments, a first compartment of a multi-compartment container may be connected to only one second compartment, or may be connected to more than one second compartments. For example, the first compartment may be connected to a second compartment arranged on a first side of the first compartment, and connected to a third compartment arranged on a second side of the first compartment.

Referring again to FIG. 1, the frame of a compartment forms a uniform, solid frame that surrounds the top edge of the cup and provides strength and stability to the compartment. Also, when the respective frames of multiple compartments are connected (in the manner illustrated in FIGS. 5-7, for example) to form a multi-compartment container system, the frames of the multiple compartments together form a uniform, solid frame that surrounds the entire set made up of all of the cups of all of the compartments. This uniform, solid frame provides strength and stability to the entire container system.

Figure 8:
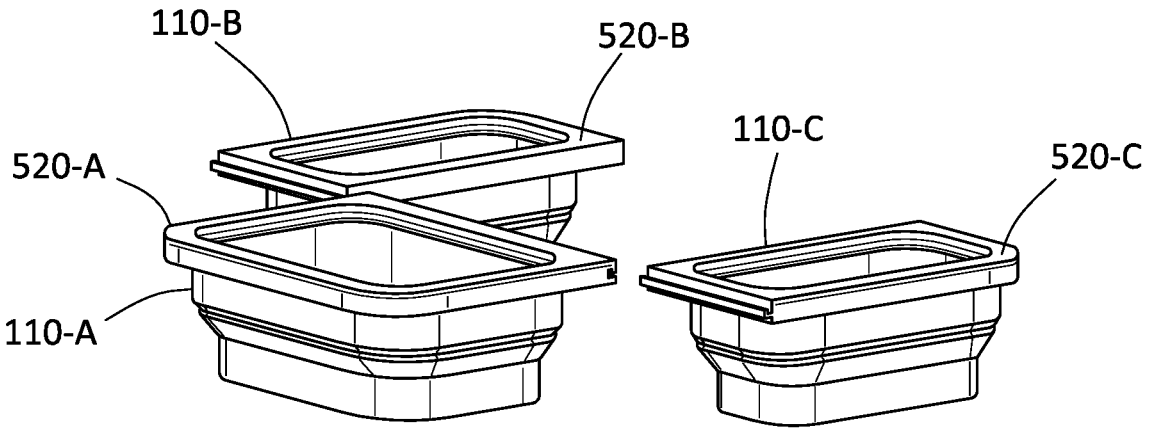
FIG. 8 shows several compartments of a multi-compartment container system in accordance with an embodiment.
Figure 9:
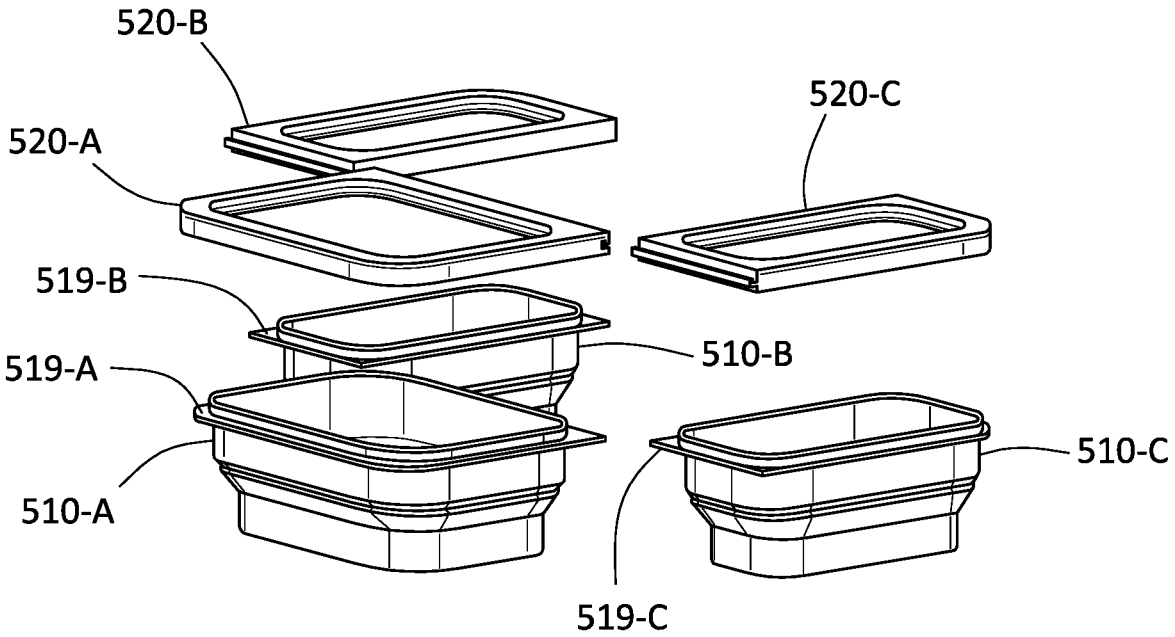
FIG. 9 shows the cups and frames of the compartments of the embodiment of FIG. 8 in a detached state.

In accordance with an embodiment, the frame of a compartment is detachably attached to the cup. Thus, in ordinary operation, the frame is attached to the cup; however, the frame may be detached in order to clean the various components or for another reason. This feature is illustrated by FIGS. 8-9. FIG. 8 shows compartments 110-A, 110-B, 110-C in accordance with an embodiment. Compartments 110-A, 110-B, 110-C are separated from one another. Each compartment 110-A, 110-B, 110-C includes a cup and a frame attached to the cup. FIG. 9 shows the cups and frames of compartments 110-A, 110-B, 110-C in a detached state in accordance with an embodiment. Thus, frame 520-A is detached from cup 510-A, frame 520-B is detached from cup 520-B, and frame 520-C is detached from cup 510-C.

In various embodiments, a compartment may include one frame, or may include a plurality of frames. In the illustrative embodiment shown in FIG. 9, two frames are attached to each cup. Specifically, a first frame 519-A is attached to a top portion of cup 510-A, a second frame 519-B is attached to a top portion of cup 510-B, and a third frame 519-C is attached to a top portion of cup 510-C. A second frame 520-A fits over first frame 519-A on cup 510-A. A second frame 520-B fits over first frame 519-B on cup 510-B. A second frame 520-C fits over first frame 519-C on cup 510-C. The two frames are coupled together to provide strength and rigidity around each cup and between the compartments.

In accordance with an embodiment, a cup of a compartment includes a top section, a middle section and a bottom section. The middle section has a bendable, foldable, or stretchable surface adapted to deform and allow the bottom section to telescope into, or be inserted into, the top section. The compartment has an expanded state, in which the top section, middle section, and bottom section of the cup are extended, and a collapsed state, in which all or a portion of the bottom section and the middle section are collapsed into the top section.

Figure 10:
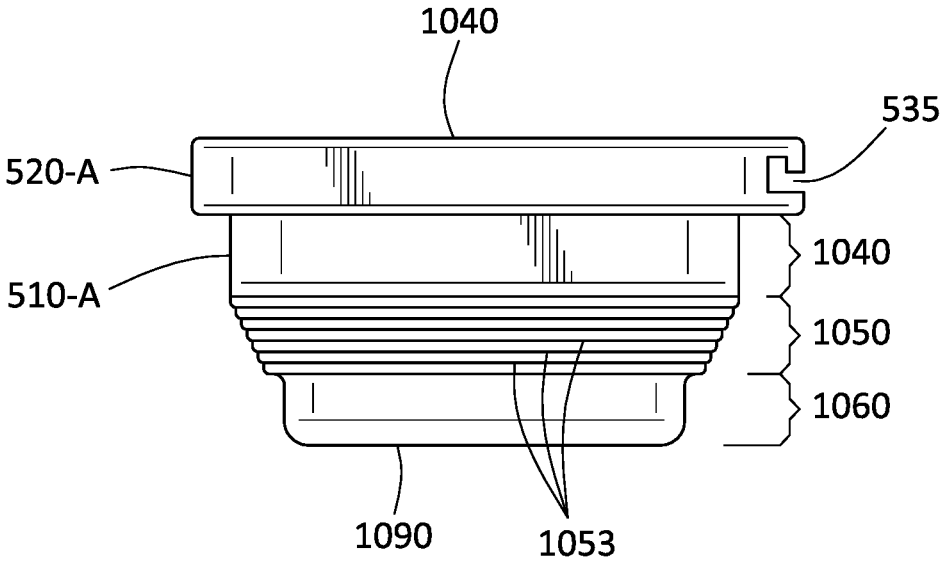
FIG. 10 shows a collapsible compartment of a multi-compartment container system in accordance with an embodiment.

FIG. 10 shows compartment 110-A in accordance with an embodiment. Cup 510-A includes a top section 1040, a middle section 1050, and a bottom section 1060. Bottom section 1060 has a bottom surface 1090. In FIG. 10, middle section 1050 is in the extended condition and thus compartment 110-A is in its expanded state.

In the illustrative embodiment of FIG. 10, middle section 1050 includes a flexible material adapted to move between an extended condition and a compressed (or bent) condition. The ability of the flexible material to be compressed (or bent) allows bottom section 1060 (including, in some embodiments, bottom surface 1090) to be pushed up so that all or a portion of bottom section 1060 (including bottom surface 1090) fits into and is held inside top section 1040. In the illustrative embodiment of FIG. 10, middle section 1050 may be formed of a material having transverse wrinkles, or alternatively a corrugated surface having a plurality of ridges separated by furrows. Thus, middle section 1050 is flexible and adapted to contract and expand, and bend in a manner that allows bottom section 1060 to be pushed into top section 1040. For example, if cup 510-A is empty, a user may use his or her hand to push bottom section 1060 up into top section 1040. In response to the pressure from the user's hand, the wrinkles or corrugations of middle section 1050 may at first contract and/or bend, and then stretch inward as bottom section is pushed into top section 1040.

Figure 11B:
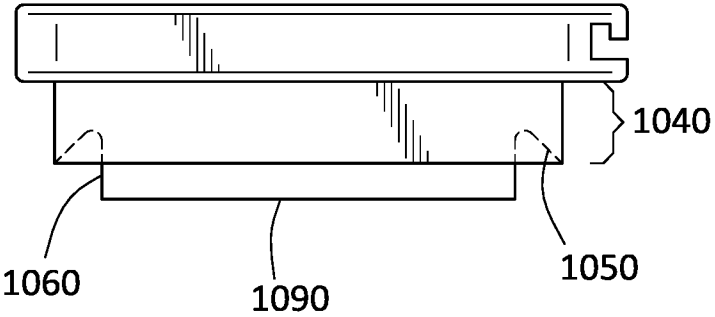
FIG. 11B shows a compartment in a collapsed state in accordance with another embodiment.
Figure 11A:
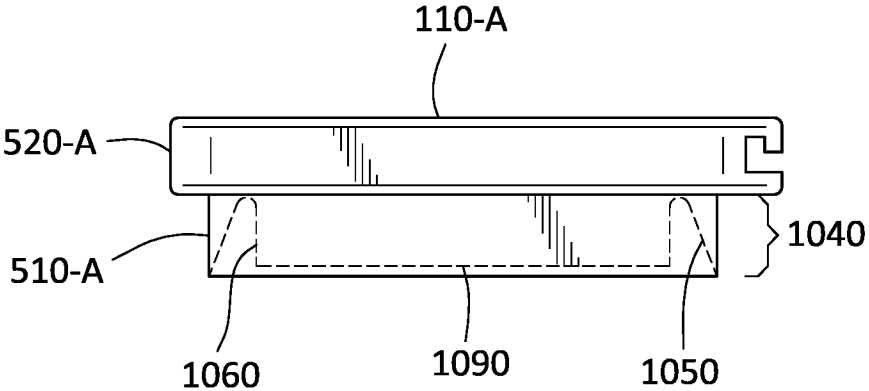
FIG. 11A shows a compartment in a collapsed state in accordance with an embodiment.

FIG. 11A shows compartment 110-A in a collapsed state (for example, after a user has pushed bottom section 1060 into top section 1040) in accordance with an embodiment. Middle section 1050 and all of bottom section 1060, including bottom surface 1090 (shown by broken lines), are collapsed into top section 1040. Advantageously, compartment 110-A takes up less space when in its collapsed state, thus facilitating easy and efficient storage. In another embodiment shown in FIG. 11B, only a first portion of bottom section 1060 fits into top section 1040 when compartment 110-A is in the collapsed state; a second portion, including bottom surface 1090, protrudes from top section 1040.

Figure 13:
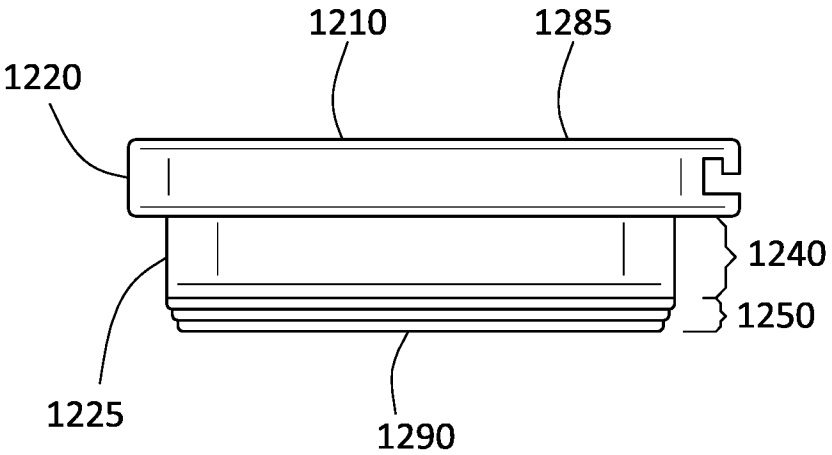
FIG. 13 shows the compartment of the embodiment of FIG. 12 in a collapsed state.
Figure 12:
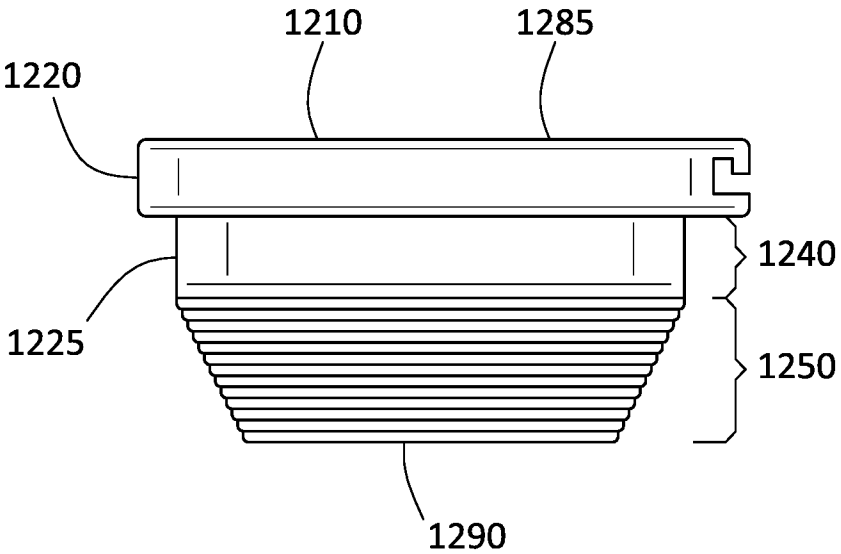
FIG. 12 shows a collapsible compartment of a multi-compartment container system in accordance with another embodiment.

The collapsibility feature of the cup portion of a compartment may be implemented in a different manner. For example, in one embodiment, a compartment includes a flexible section which can move between an extended condition and a compressed condition. The compartment is in an expanded state when the flexible section is in the extended condition and in a collapsed state when the flexible section is in the compressed state. FIGS. 12-13 show a collapsible compartment in accordance with an embodiment. Compartment 1210 includes a frame 1220 and a cup 1225. Cup 1225 includes a top section 1240 and a flexible bottom section 1250. Cup 1225 includes a top surface 1285 and a bottom surface 1290. Flexible bottom section 1250 includes a flexible material having wrinkles, or alternatively a corrugated material, adapted to extend to an extended condition associated with a first size, and be compressed and collapsed to a compressed condition associated with a size smaller than the first size. FIG. 12 shows compartment 1210 in an expanded state in accordance with an embodiment. In FIG. 12, bottom section 1250 is in the extended condition. FIG. 13 shows compartment 1210 when bottom section 1250 is in the compressed condition. In this embodiment, a distance from top surface 1240 to bottom surface 1290 decreases when compartment transitions from the expanded state to the compressed state. For example, in one embodiment, the distance from top surface 1285 to bottom surface 1290 when compartment 1210 is in the compressed state is less than one-half the distance from top surface 1285 to bottom surface 1290 when compartment 1210 is in the expanded state.

Figure 14:
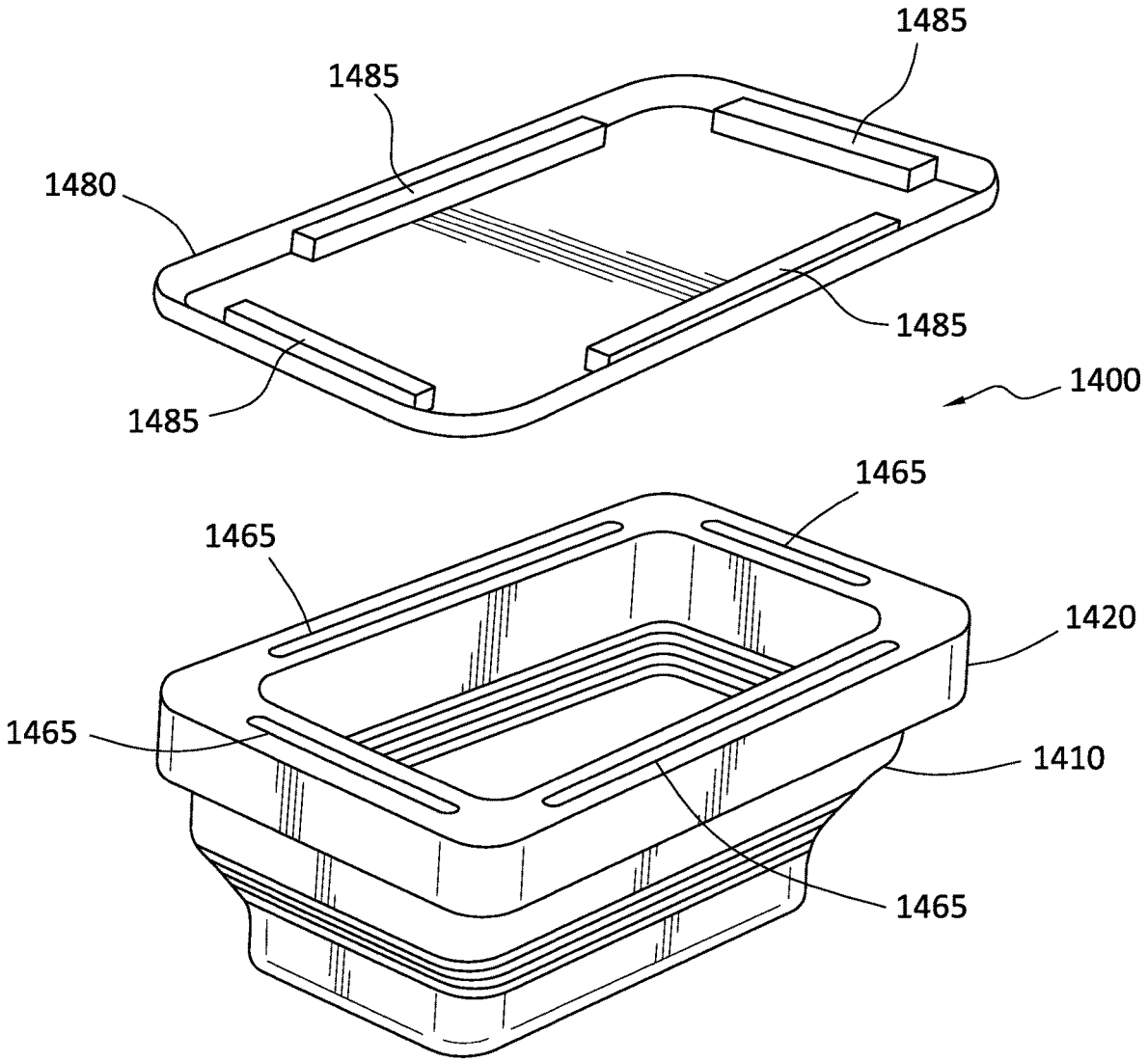
FIG. 14 shows a compartment of a multi-compartment container system in accordance with another embodiment.
Figure 15:
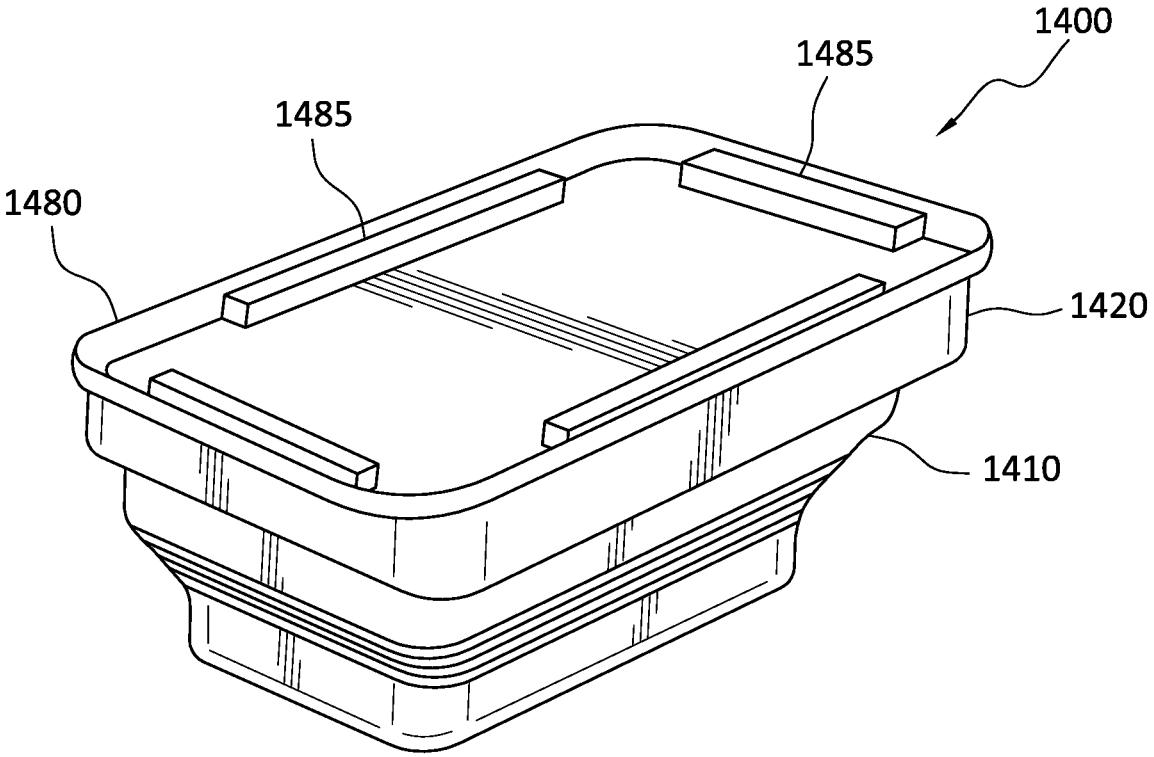
FIG. 15 shows the compartment of the embodiment of FIG. 14 with a lid securely attached to the frame.

In accordance with an embodiment, a compartment of a multi-compartment container system includes a lid that provides an airtight seal. FIG. 14 shows a compartment in accordance with an embodiment. Compartment 1400 includes a frame 1420, a cup 1410, and a lid 1480. A plurality of projections 1465 are disposed on the frame 1420 and are adapted to engage with corresponding grooves on the underside of lid 1480 (not shown in FIG. 14). Lid 1480 include a plurality of structural elements 1485 that contain grooves that correspond to projections 1465. When projections 1465 engage with the grooves of structural elements 1485, the connections cause the lid be firmly and securely attached to frame 1420, forming an airtight seal. FIG. 15 shows compartment 1400 when lid 1480 is securely attached to frame 1420.

Figure 16:
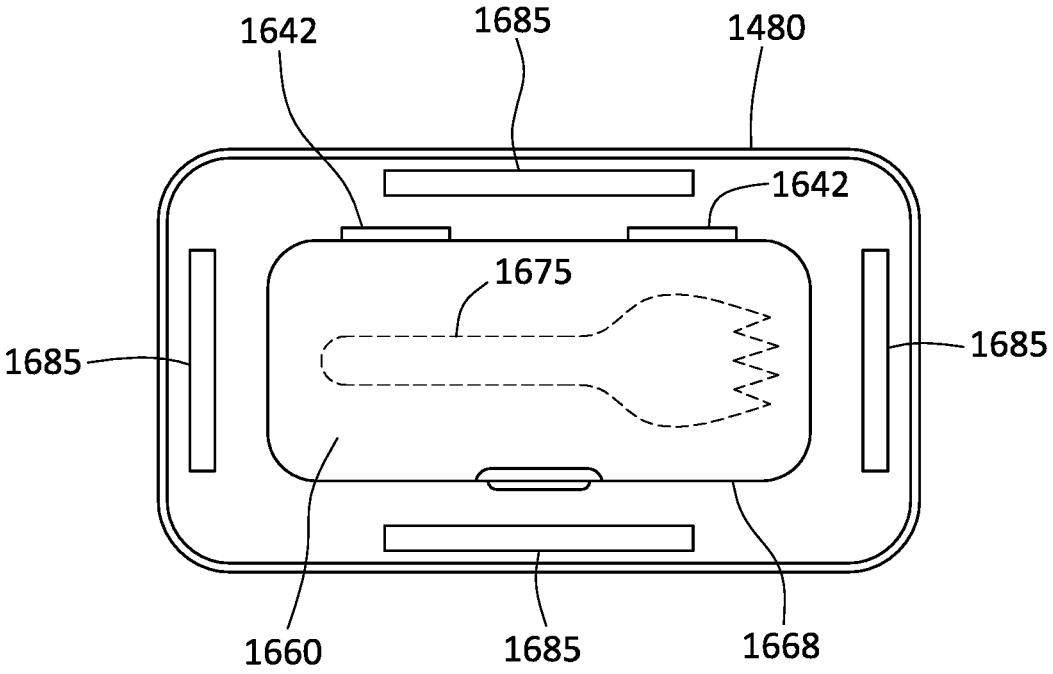
FIG. 16 shows the underside of a lid of a compartment in accordance with an embodiment.

FIG. 16 shows the underside of lid 1480 in accordance with an embodiment. Lid 1480 includes grooves 1685 that correspond to elements 1485 (shown in FIGS. 14-15). Grooves 1685 receive projections 1465 of frame 1420. When projections 1465 are firmly engaged in grooves 1685, an airtight seal is formed.

In another embodiment, a projecting ridge may run along the entire upper surface of the frame of a compartment, forming a single peripheral projection that may engage with a corresponding groove in the lid to form an airtight seal.

In another embodiment, a lid may include a strip of rubber, secured to the underside of the lid, which aligns to the top of the frame when the lid is attached to the frame.

While in the illustrative embodiment, frame 1420 includes a plurality of projections and lid 1480 includes corresponding grooves which are adapted to mate with the projections to form a seal, in other embodiments, the frame and the lid may include other types of mating elements adapted to mate together to form an airtight seal. For example, without limitation, a latch may be used, or threads may be used on the frame and lid to allow the lid to be rotated onto the frame.

Lid 1480 also includes an enclosed chamber 1660 adapted to hold one or more utensils. In the illustrative embodiment, chamber 1660 holds a spork; however, in other embodiments, chamber 1660 may hold a fork, a spoon, a knife, chopsticks, a straw, or another type of utensil. For example, in one embodiment, the chamber may hold a fork, a knife, and a spoon. In one embodiment, chamber 1660 contains a connector (such as a clasp, a clip, a cavity, etc.) that allows the utensil to be secured into chamber 1660. Chamber 1660 is enclosed by a cover 1668 (which may be a door, for example) attached to the lid by hinges 1642. In other embodiments, a chamber in the lid may be enclosed by another type of mechanism, such as a lid, a cover that screws on and off, a sliding panel, etc. Cover 1660 may be transparent, translucent, or opaque. In another embodiment, the chamber in the underside of the lid is adapted to hold a food or liquid.

In accordance with an embodiment, one or more components of a multi-compartment container (including the cup, the frame, the lid, etc.) are formed of a material that includes glass microspheres. The glass microspheres may be, for example, hollow glass microspheres. For example, in one embodiment, one or more components are manufactured using injection molding. During the manufacturing system and process, hollow glass microspheres are included in the injection molded components and extruded profiles.

Figure 17:
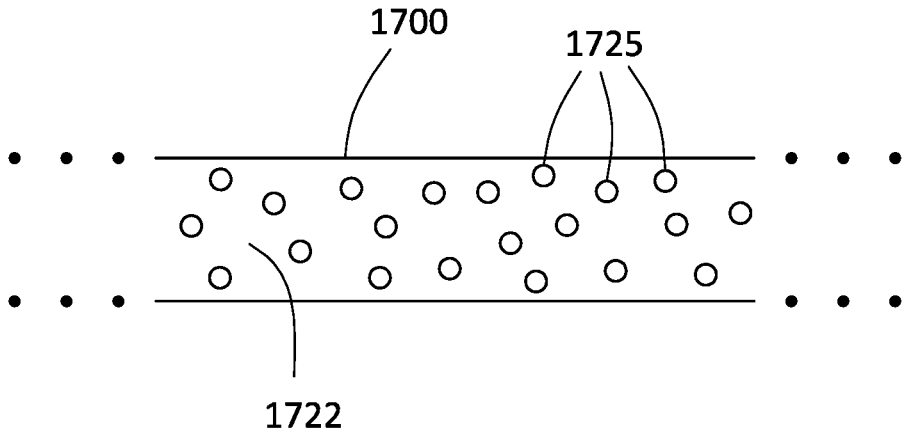
FIG. 17 shows a cross-section of a portion of a component of a multi-compartment container system in accordance with an embodiment.

Thus, in accordance with an embodiment, a component of a multi-compartment container includes a material that includes a plurality of hollow glass microspheres. FIG. 17 shows a cross-section of a portion of a component 1700, which may be, for example, a frame similar to frame 520-A (shown in FIG. 5), a cup similar to cup 510-A (shown in FIG. 5), or a lid similar to lid 1480 (shown in FIG. 14). The component 1700 is formed of a material 1722 and includes a plurality of glass microspheres 1725 embedded in the material. The microspheres advantageously are lightweight and thus reduce the weight of the component. All or a portion of a component may be formed of a material that includes glass microspheres.

Glass microspheres are free flowing powders consisting of, for example, thin walled hollow glass microspheres. They have a high strength to density ratio, and are both lightweight and strong enough to survive processing. The microspheres offer the least surface area per volume of any shape, which allows microspheres to help reduce resin demand in a variety of applications—for lower raw materials cost. Lightweight glass microspheres advantageously occupy up to twenty times more space than an equal weight of typical mineral filler.

In another embodiment, a resin system is used, which can decrease thermal conductivity, depending on the grade and amount of microspheres used. The microspheres advantageously exhibit low thermal conductivity and are therefore useful in a thermal insulating syntactic.

In one embodiment, 3M Glass Bubbles®, manufactured by 3M® of St. Paul, Minn., may be used. Other types of glass microspheres may be used.

Figure 18:
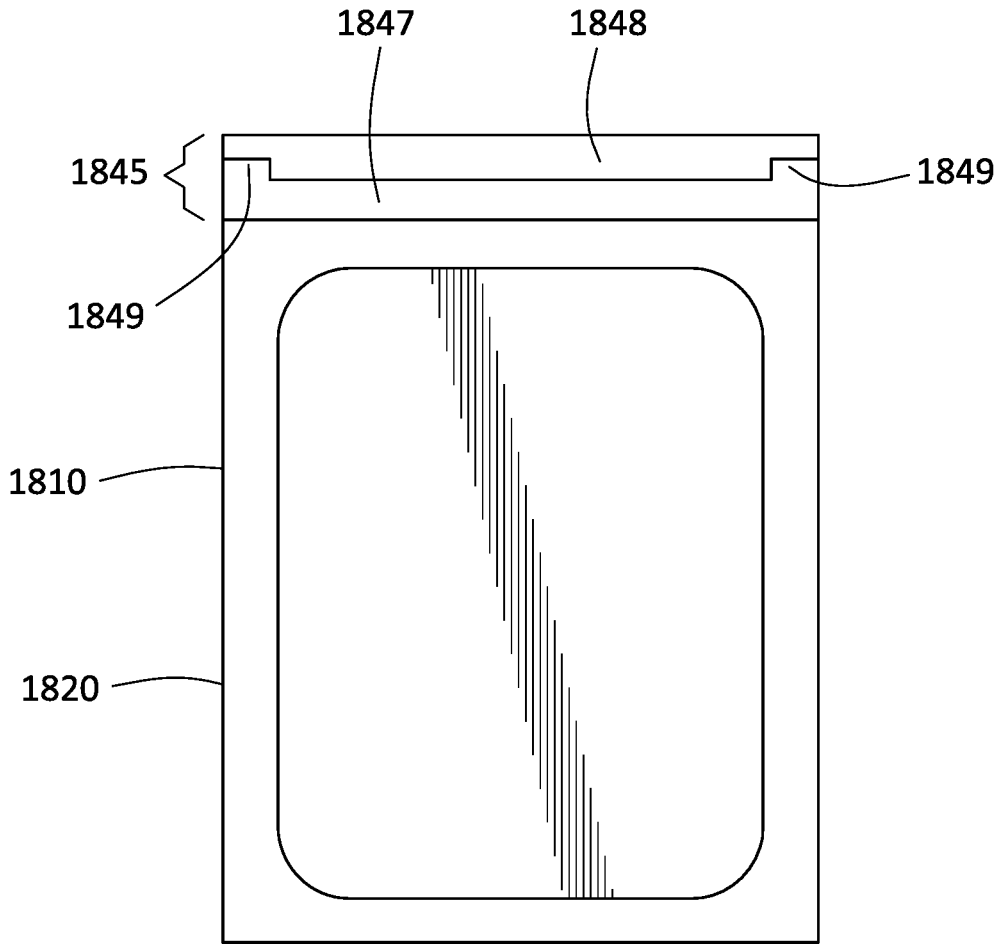
FIG. 18 shows a top view of a compartment in accordance with another embodiment.

FIG. 18 shows a top view of a compartment in accordance with another embodiment. Compartment 1810 includes a frame portion 1820. Frame portion 1820 includes a connector element 1845 that is adapted to be connected to a second connector element of another compartment. Connector element 1845 is disposed on one side of compartment 1810. In other embodiments, a compartment may have connector elements on more than one side.

Connector element 1845 is a projecting element that functions as a sliding component. Connector element 1845 includes a first portion 1847 having a first, lower level, and a second portion 1848 having a second, raised level different from the first, lower level. First, lower portion 1847 extends along the entire side of compartment 1810. Second, raised portion 1848 also extends along the entire side of compartment 1810. Second, raised portion 1848 includes a notch 1849 at both ends. Notch 1849 does not have the second, raised level, but instead has the first, lower level.

Raised portion 1848 therefore has a first region (the region between the notches) having a first width. Raised portion 1848 also has one or more second regions disposed where a notch is present; each second region has a width smaller than the first width.

Figure 19:
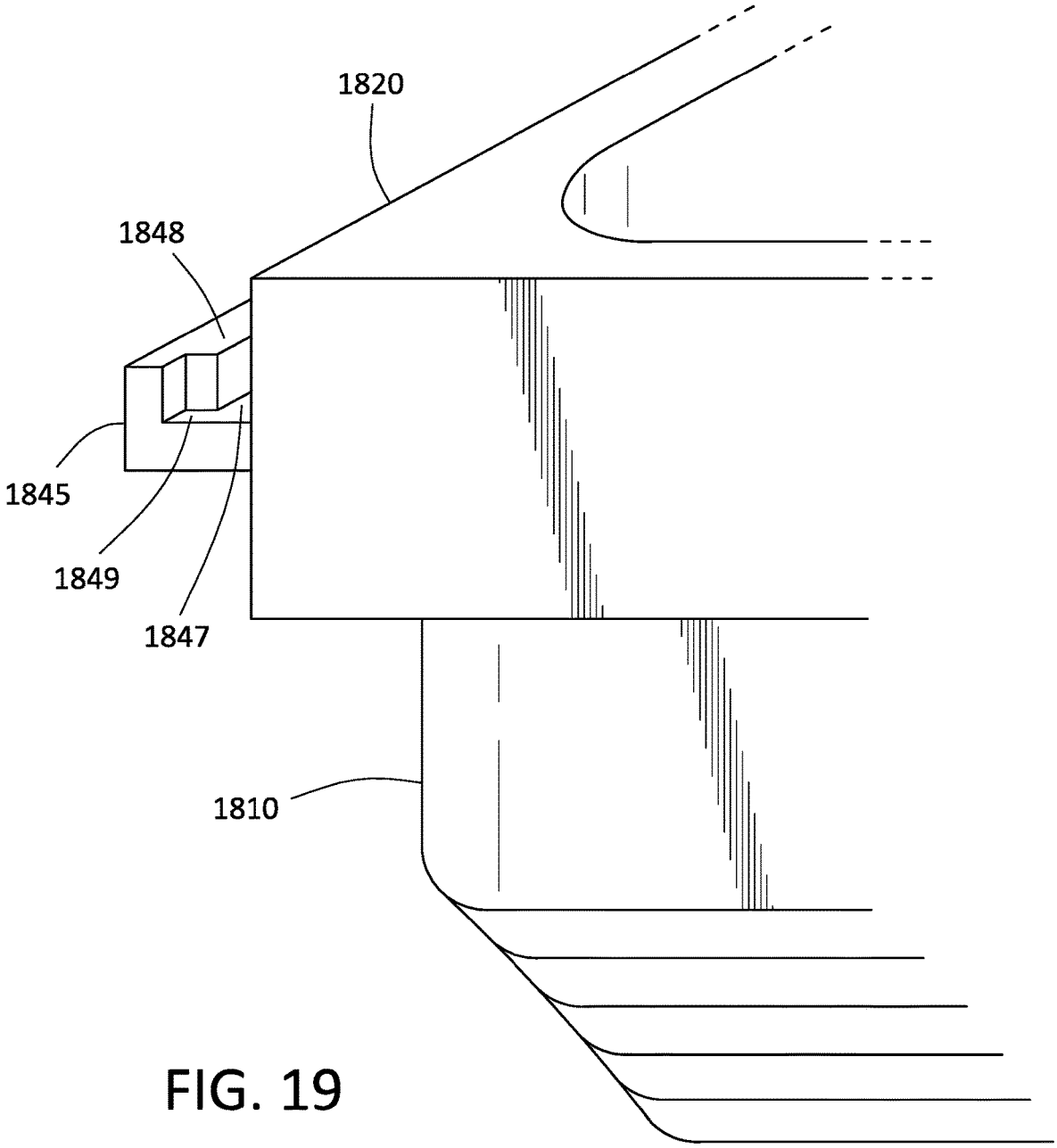
FIG. 19 shows a perspective view of the compartment of the embodiment of FIG. 18.
Figure 20:
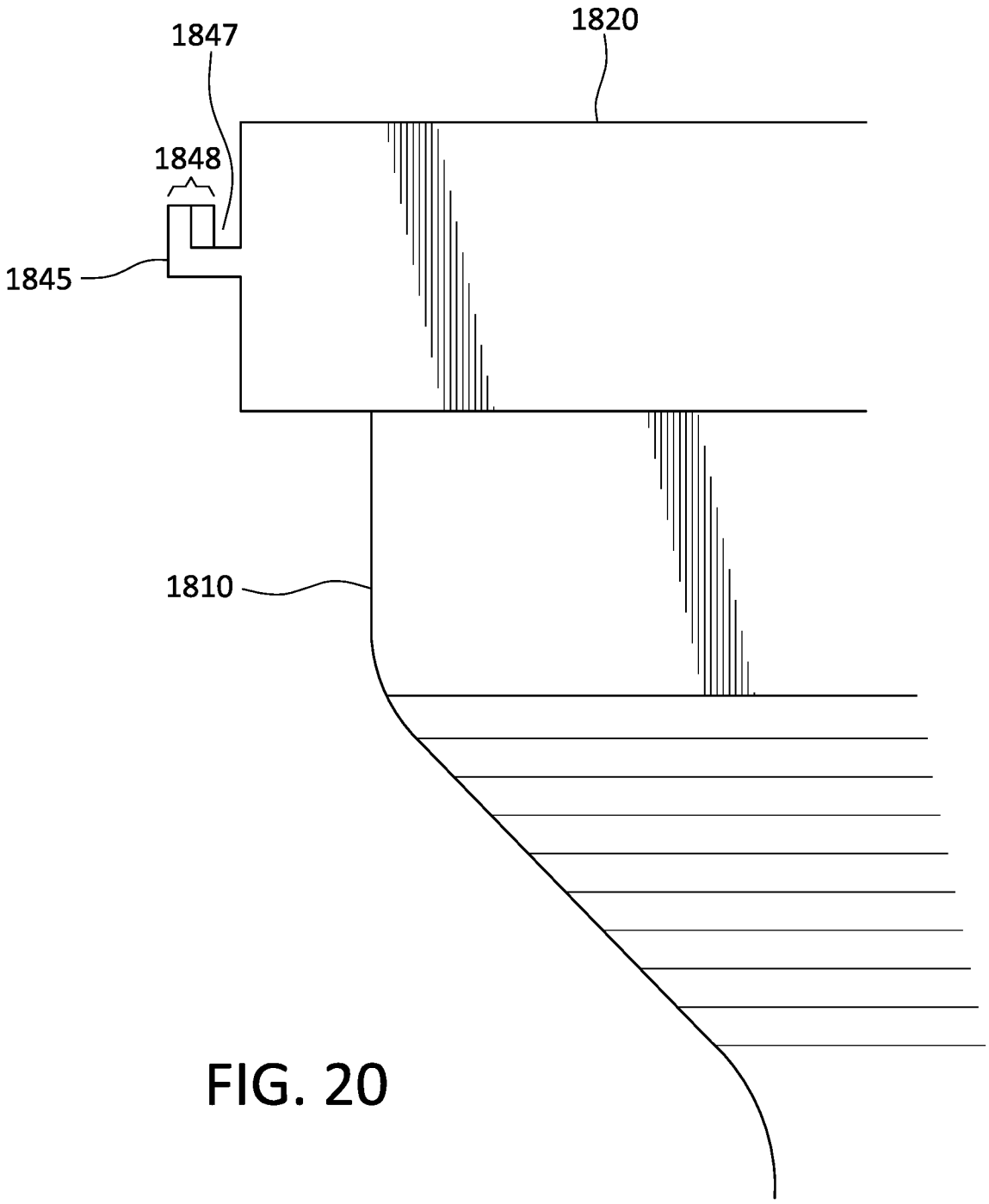
FIG. 20 shows a side view of the compartment of the embodiment of FIG. 18.

FIG. 19 shows a perspective view of the compartment of the embodiment of FIG. 18. FIG. 20 shows a side view of the compartment of the embodiment of FIG. 18. Connector element 1845 projects from the side of frame portion 1820. The first, lower level of first portion 1847 (and of notch 1849) and the second, raised level of second portion 1848 are visible in FIGS. 19 and 20.

Figure 21:
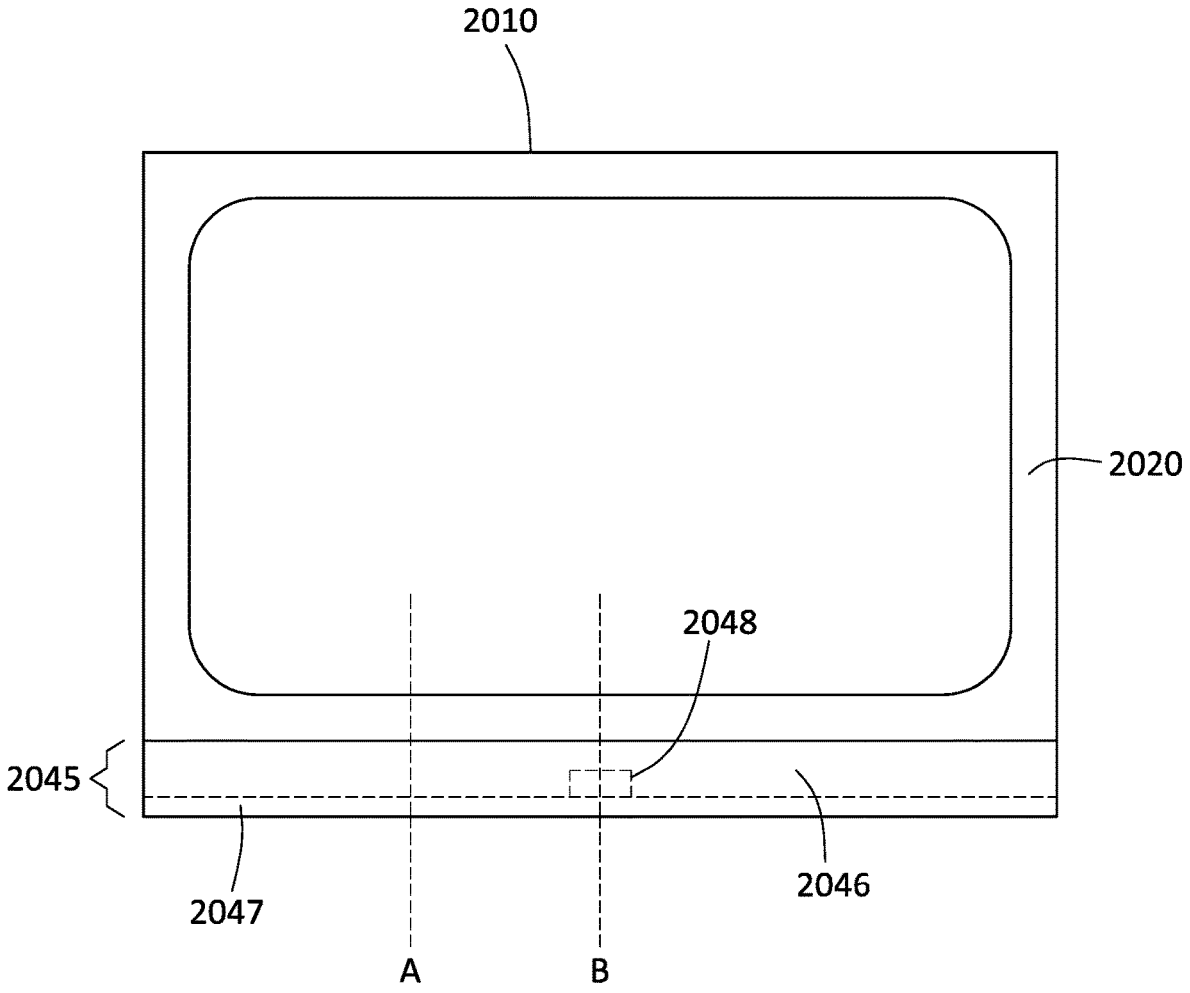
FIG. 21 shows a compartment in accordance with another embodiment.

FIG. 21 shows a compartment in accordance with another embodiment. Compartment 2010 includes a frame portion 2020, which includes a connector element 2045. Connector element 2045 is disposed on one side of frame portion 2020. In other embodiments, a compartment may include more than one connector elements disposed on more than one of the sides of the frame portion. Connector element 2045 includes a projecting element 2047 that defines a cavity or slot 2046. Projecting element 2047 and slot 2046 extend along the entire length of the side of compartment 2010.

Projecting element 2047 includes an internal blocking element 2048 which projects into the slot at a selected location. In the illustrative embodiment, blocking element 2048 is disposed at or near a central point of slot 2046. Blocking element 2048 reduces the width of slot 2046. In other embodiments, a blocking element may be disposed at other locations within a slot of a connector element. In other embodiments, a connector element may include more than one blocking element.

Therefore, connector element 2045 includes slot 2046 which includes a first region in which blocking element 2048 is not present and which has a first internal width, and a second region in which blocking element 2048 is present and which has a second, narrower internal width that is smaller than the first internal width.

Figure 22:
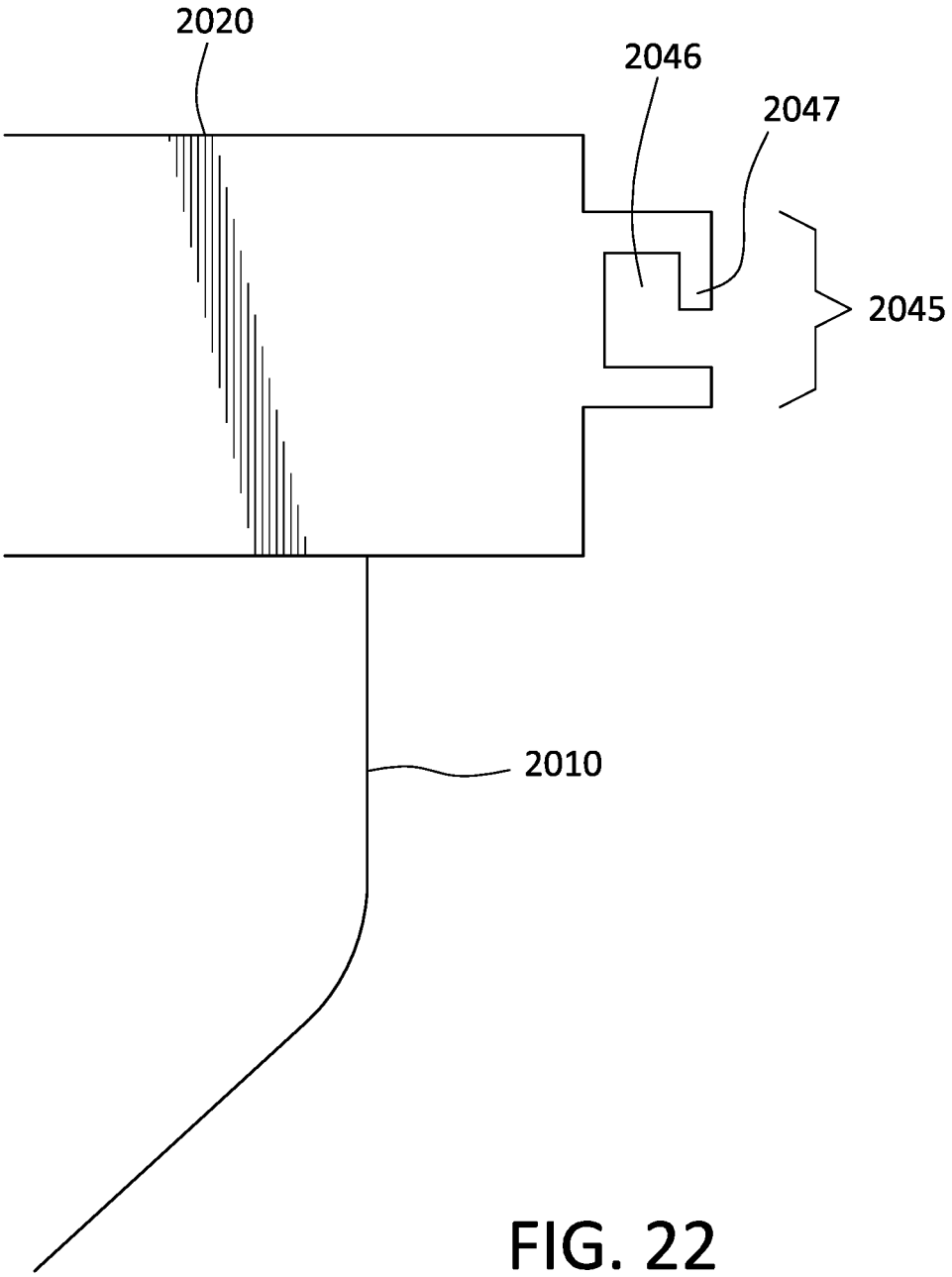
FIG. 22 shows a cross-section of the compartment and connector element of the embodiment of FIG. 21 along line A.

FIG. 22 shows a cross-section of the compartment and connector element of the embodiment of FIG. 21 along line A. As shown in FIG. 22, blocking element 2048 is not present at line A.

Figure 23:
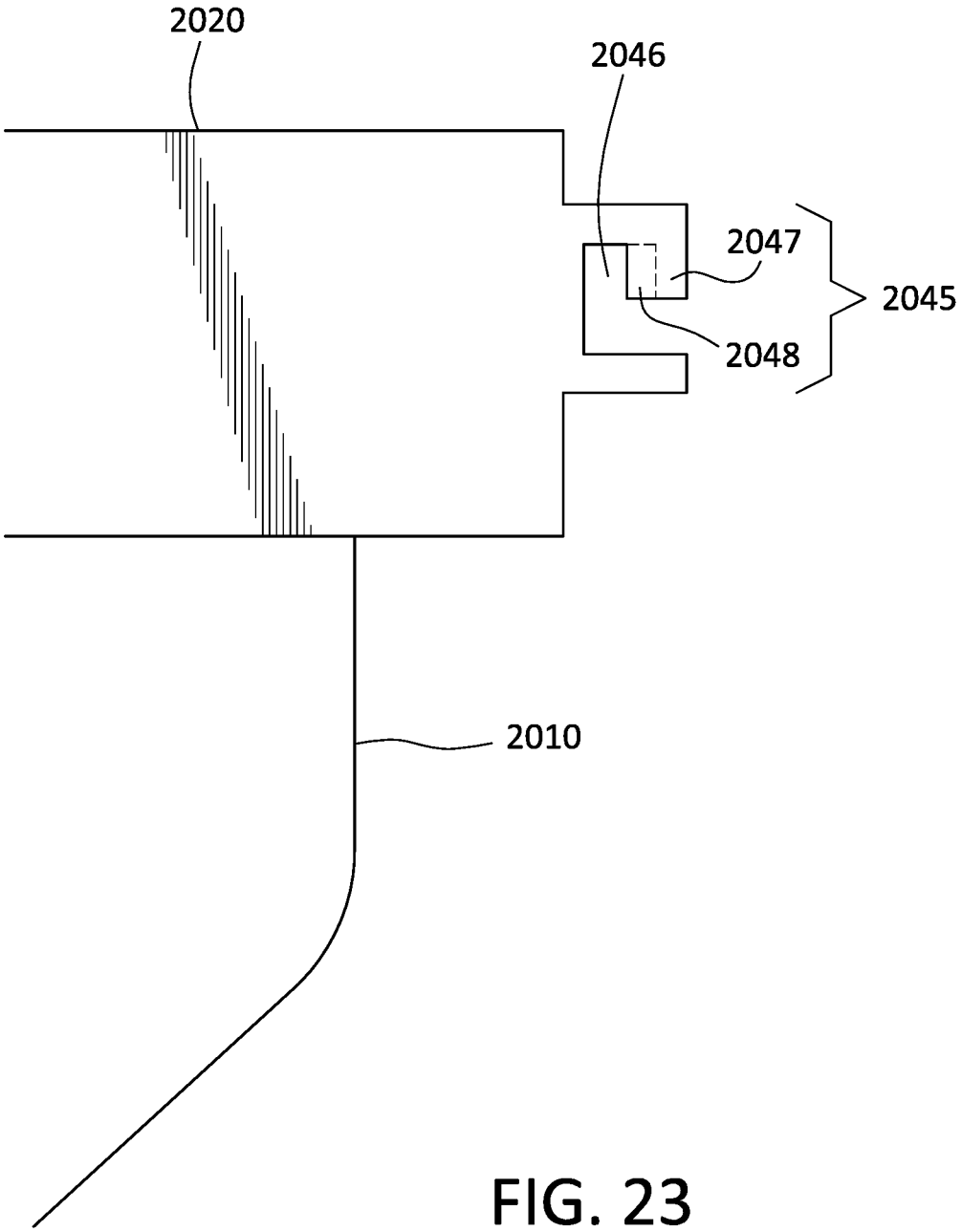
FIG. 23 shows a cross-section of the compartment and connector element of the embodiment of FIG. 21 along line B.

FIG. 23 shows a cross-section of the compartment and connector element of the embodiment of FIG. 21 along line B. As shown in FIG. 23, blocking element 2048 projects into slot 2046 at line B. Blocking element 2048 reduces the width of slot 2046 in the region where blocking element 2048 is present. As a result, (and as is apparent from a comparison of FIGS. 22 and 23), the width of slot 2046 is wider at line A than at line B, because blocking element 2048 is not present at line A; however, the blocking element is present at line B and narrows the internal width of slot 2046 at line B.

Referring now to FIG. 18 and to FIG. 21, the first width of the raised portion 1848 (in the region between the notches) is smaller than the width of slot 2046 at line A;

therefore, raised portion 2046 fits into and can slide within slot 2046 in the region of slot 2046 where blocking element 2048 is not present. However, the first width of raised portion 1848 (in the region between the notches) is larger than the width of slot 2046 at line B (wherein the blocking element is present); therefore, raised portion 1848 cannot fit into or slide within the region of slot 2046 where blocking element 2048 is present. However, the second width of raised portion 1848 (in the region(s) where a notch is present) is smaller than the width of slot 2046 at line B (where the blocking element is present), and therefore can fit into and slide within slot 2046 in the region where blocking element 2048 is present.

Figure 24:
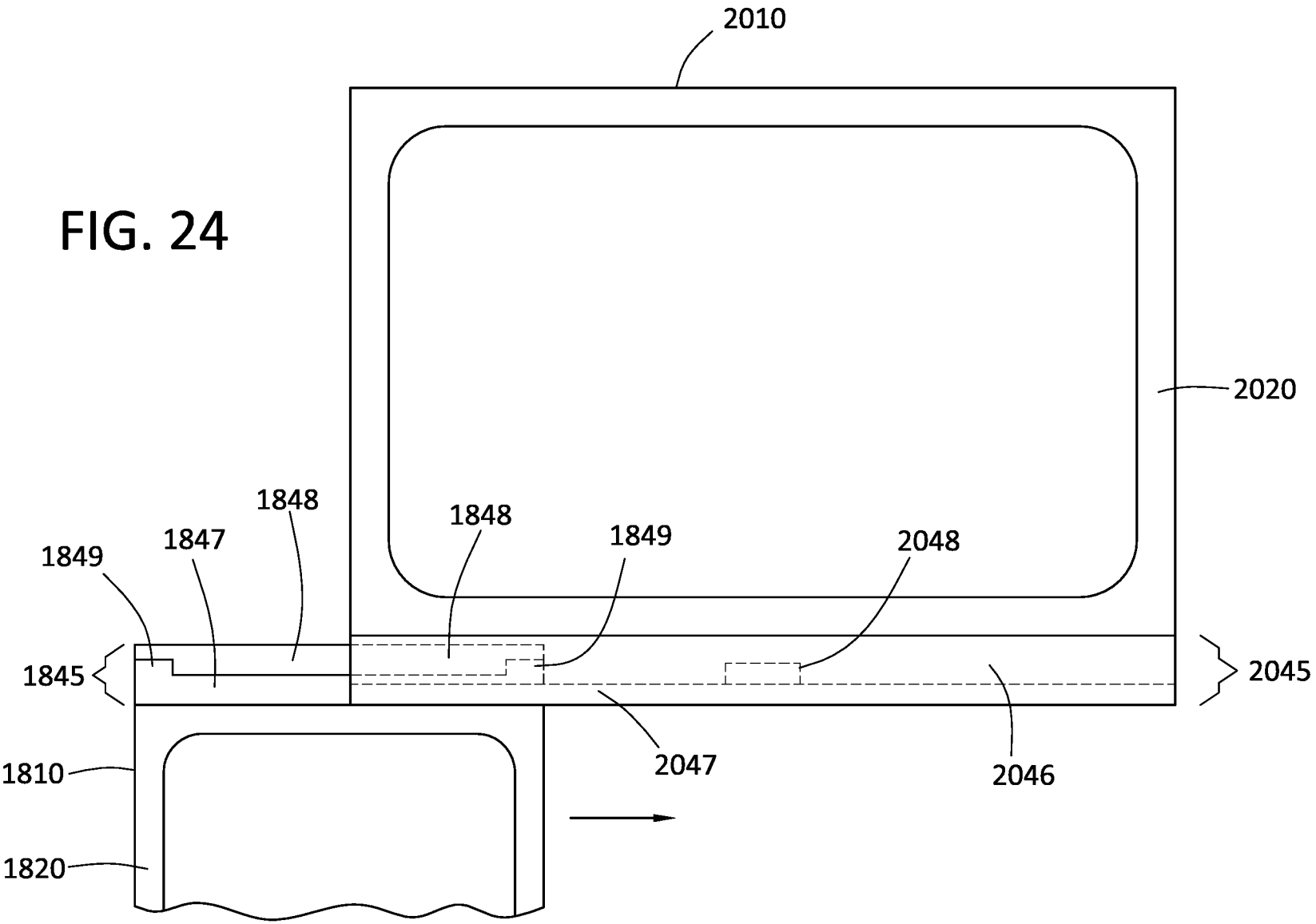
FIGS. 24-26 show a method of connecting compartments to form a collapsible multi-compartment container system.
Figure 25:
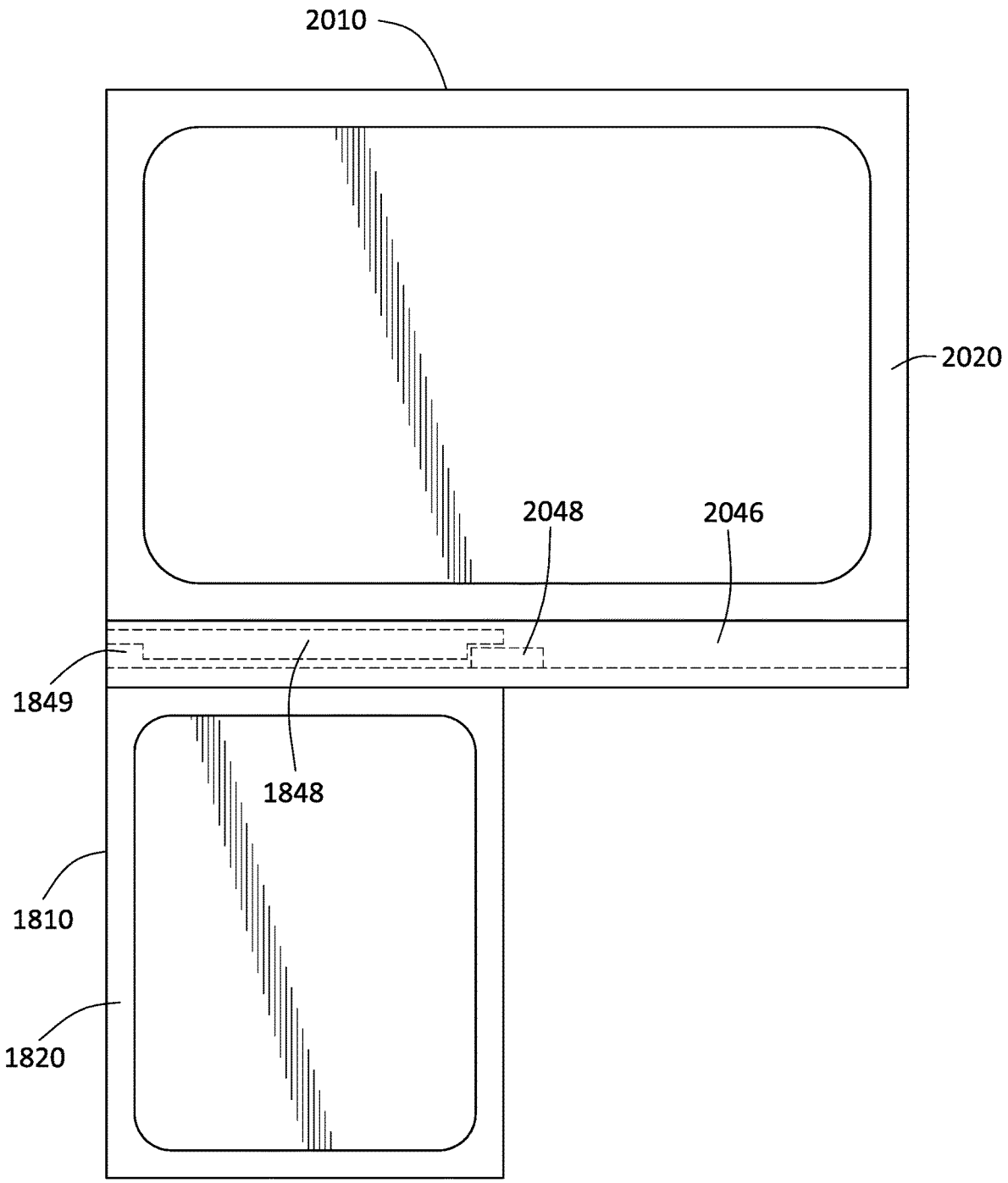
Figure 26:
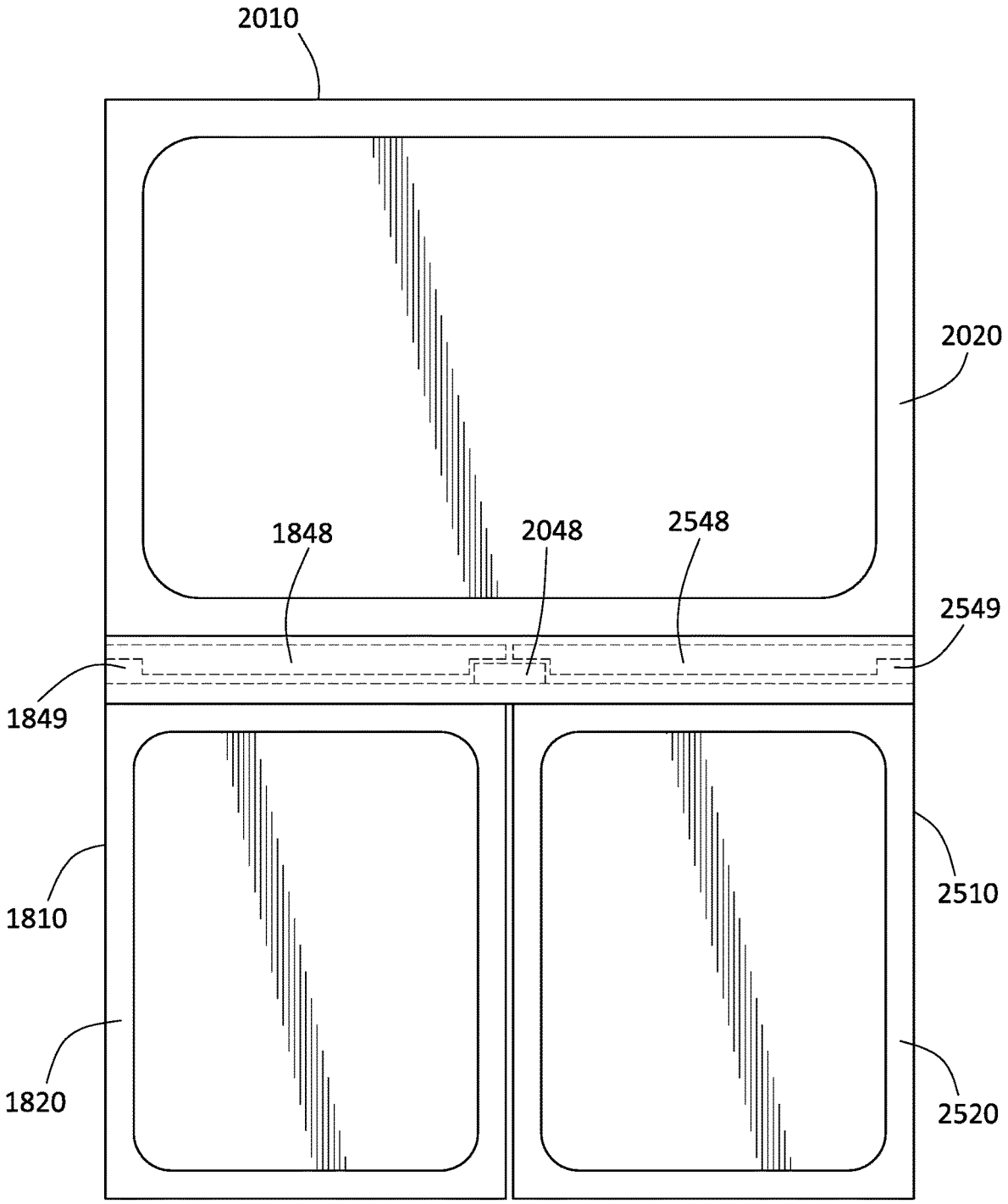

FIGS. 24-26 show a method of connecting the compartment of the embodiment of FIGS. 18-20 with the compartment of the embodiment of FIGS. 21-23. Referring to FIG. 24, connector element 1845 of compartment 1810 fits into and slides within connector element 2045 of compartment 2010. In particular, second, raised portion 1848 of connector element 1845 fits into and slides within slot 2046 of connector element 2045. In the portion of slot 2046 in which blocking element 2048 is not present, raised portion 1848 slides freely within slot 2046. As shown in FIG. 25, when the raised portion 1848 meets blocking element 2048, raised portion 1848 is blocked and compartment 1810 cannot slide any further. In the illustrative embodiment, all or a portion of blocking element 2048 fits into notch 1849 to allow compartment 1810 to fit entirely into one-half of slot 2046.

In the illustrative embodiment, a third compartment similar to compartment 1810 may be connected to compartment 2010 on the opposite side of blocking element 2048, using a method similar to that used to connect compartment 1810, to form a collapsible multi-compartment container system. FIG. 26 shows compartment 1810 connected to compartment 2010, and a third compartment 2510 (which is similar to compartment 1810) connected to compartment 2010. Thus, compartment 2510 includes a frame portion 2520 and a connector element having a raised portion 2548 and one or more notches 2549. In a manner similar to that described above, the connector element of compartment 2510 fits into and slides within slot 2046 until raised portion 2548 meets, and is blocked by, blocking element 2048. A portion of blocking element 2048 first into a notch of raised element 2548, allowing compartment 2510 to fit entirely within one-half of slot 2046. As shown in FIG. 26, the three connected compartments 2010, 1810, and 2510 form a collapsible multi-compartment container system.

In one embodiment, the compartments of a multi-compartment container system are connected by frames (connecting sections) having a high structural rigidity.

In another embodiment, the compartments are adapted to maintain different temperatures, so that some compartments may hold heated foods or liquids while other compartments may hold cold foods or liquids. One or more components of the compartments and container systems described herein may be formed of silicone. For example, one or more components may be made from 100% food-grade silicone. Silicone has natural insulating properties. Other materials may be used, such as, for example, without limitation, metal, plastic, rubber, etc.

In one embodiment, a compartment of a container system is leak-proof.

In another embodiment, one or more components of a container system are formed from food-grade silicone. In another embodiment, one or more components of a container system are formed from BPA-free materials.

In another embodiment, components of a container system are formed from freezer-safe, dishwasher safe, and microwave-safe materials.

In another embodiment, the structure of a multi-compartment container system advantageously provides low-carbon profile and environmental friendliness, no toxicity, flexibility, and is resistant to high and low temperatures.

In various embodiments, a multi-compartment container system may have any number of compartments, and the compartments may have different sizes. For example, a container system may have 2, 3, 4, or more compartments. A container system may have greater than 4 compartments. For example, a compartment may hold between 1-4 cups. In other embodiments, a compartment may have a volume of less than one cup. For example, a compartment may have a volume of one-half (½) cup, three-fourths (¾) of one cup, one-third (⅓) of one cup, etc. In other embodiments, a compartment may hold greater or smaller quantities than those disclosed herein.

For example, a multi-compartment container system may have 4 compartments that hold 1 cup each.

For example, a multi-compartment container system may have 3 compartments, including 2 compartments that hold 1 cup and 1 compartment that holds 2 cups.

For example, a multi-compartment container system may have 2 compartments that hold 2 cups each.

Other sizes, dimensions, and arrangements not disclosed herein may be used.

Thus, in accordance with an embodiment, a multi-compartment container system includes a plurality of compartments. Each compartment includes a cup portion comprising a volume adapted to hold a food or liquid, and a frame portion joined to the cup portion. The frame portion surrounds a top edge of the cup portion, and includes a connector element disposed on a side of the frame and one or more first mating elements. The compartment also includes a lid having one or more second mating elements adapted to engage with the one or more first mating elements of the frame to form a seal, and a chamber adapted to hold a utensil. The connector element of the frame is joined to an adjacent connector element of an adjacent frame of an adjacent compartment.

In one embodiment, the cup portion includes a first section and a second section. The cup portion is adapted to move between an expanded state in which no part of the second section is inside the first section and a collapsed state in which at least a portion of the second section is inside the first section.

In another embodiment, the cup portion further includes a flexible section adapted to move between an extended condition and a compressed condition. The cup portion is in the expanded state when the flexible section is in the extended condition, and the cup portion is in the collapsed state when the flexible section is in the compressed condition.

In another embodiment, the cup portion further includes a flexible section adapted to move between an extended condition and a bent condition. The cup portion is in the expanded state when the flexible section is in the extended condition, and the cup portion is in the collapsed state when the flexible section is in the bent condition.

In another embodiment, the frame includes a top surface, and the cup portion includes a top section and a bottom section. The bottom section has a bottom surface. The top surface and the bottom surface are separated by a first distance when the cup portion is in the expanded state, and the top surface and the bottom surface are separated by a second distance when the cup portion is in the collapsed state, wherein the second distance is less than one-half the first distance.

In another embodiment, at least one of the cup portion, the frame portion, and the lid comprises silicone.

In another embodiment, at least one of the cup portion, the frame portion, and the lid comprises glass microspheres.

In another embodiment, the connector element includes a cavity and the adjacent connector element comprises a projecting element adapted to fit into the cavity.

In another embodiment, the cavity includes a first region having a first width and a second region having a second width smaller than the first width. The projecting element includes a sliding portion having a third width smaller than the first width and larger than the second width. The sliding portion is adapted to fit into and slide within the first region, and the sliding portion is blocked by and cannot slide within the second region.

In another embodiment, the connector element further includes a blocking element disposed in the second region that reduces a width of the cavity. The projecting element further includes a notch. At least a portion of the blocking element fits into the notch.

In another embodiment, the first mating element includes a projecting element and the second mating element includes a groove adapted to receive the projecting element.

In another embodiment, the utensil is a spork, a fork, a spoon, a knife, a straw, or chopsticks.

In another embodiment, the lid further includes a cover adapted to cover the chamber and enclose the utensil.

In another embodiment, a multi-compartment container system includes a first compartment that includes a first cup portion comprising a first volume adapted to hold a first food or first liquid and a first frame portion joined to the first cup portion. The first frame portion surrounds a first top edge of the first cup portion, and includes a first connector element disposed on a first side of the first frame, and one or more first mating elements. The container system also includes a first lid which as one or more second mating elements adapted to engage with the one or more first mating elements of the first frame to form a first seal, and a first chamber adapted to hold a first utensil. The container system also includes a second compartment connected to the first compartment. The second compartment includes a second cup portion comprising a second volume adapted to hold a second food or second liquid, and a second frame portion joined to the second cup portion. The second frame portion surrounds a second top edge of the second cup portion. The second frame portion includes a second connector element disposed on a second side of the second frame and connected to the first connector element of the first frame of the first compartment. The second frame also includes one or more third mating elements. The container system also includes a second lid having one or more fourth mating elements adapted to engage with the one or more third mating elements of the second frame to form a second seal, and a second chamber adapted to hold a second utensil.

In another embodiment, the first cup portion further includes a first section and a second section. The first cup portion is adapted to move between an expanded state in which no part of the second section is inside the first section and a collapsed state in which at least a portion of the second section is inside the first section.

In another embodiment, at least one of the first cup portion, the first frame portion, and the first lid includes silicone.

In another embodiment, at least one of the first cup portion, the first frame portion, and the first lid includes glass microspheres.

In another embodiment, the first connector element includes a cavity and the second connector element comprises a projecting element adapted to fit into the cavity.

Advantageously, the compartments and container systems described herein provide a collapsible multi-compartment container having compartments that are detachable from one another and re-attachable to one another, and are connected by connecting sections that are convenient and easy to use and have a structural rigidity that is sufficient to prevent unwanted separation of the compartments from one another (for example, when only one or a subset of the compartments are supported by a user's hand). Advantageously, the compartments and container systems described herein also provide a container system in which compartments are interchangeable, providing a user the ability to optimize his or her control over portion sizes by mixing and matching compartments of different volume capacities.

Several alternative embodiments and examples have been described and illustrated herein. The embodiments described above are intended to be exemplary only. One skilled in the art would appreciate the features of the individual embodiments, and the possible combinations and variations of the components. A person skilled in the art would further appreciate that any of the embodiments can be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein.

Accordingly, while specific embodiments have been illustrated and described, numerous modifications come to mind without significantly departing from the scope of the invention as defined in the appended claims.

The invention claimed is:

1. A multi-compartment container system comprising:

a plurality of compartments, each compartment comprising:

a cup portion comprising a volume adapted to hold a food or liquid;

a frame portion joined to the cup portion, the frame portion surrounding a top edge of the cup portion, the frame portion comprising:

a connector element disposed on a side of the frame; and one or more first mating elements; and a lid comprising:

one or more second mating elements adapted to engage with the one or more first mating elements of the frame to form a seal; and a chamber adapted to hold a utensil;

wherein the connector element of the frame is joined to a first adjacent connector element of a first adjacent frame of a first adjacent compartment and to a second adjacent connector element of a second adjacent frame of a second adjacent compartment, wherein:

the connector element comprises a cavity comprising a first end, a second end, a first region proximate the first end, the first region having a first width, a second region proximate the second end, the second region having the first width, a third region having a second width smaller than the first width, the third region being disposed between the first and second regions, and a blocking element disposed in the third region that reduces a width of the cavity in the third region;

the first adjacent connector element comprises a first projecting element adapted to fit into the first end of the cavity, the first projecting element including a first sliding portion having a third width smaller than the first width and larger than the second width, wherein the first sliding portion is adapted to fit into and slide within the first region, wherein the first sliding portion includes a first notch adapted to receive at least a first portion of the blocking element, wherein the first sliding portion is blocked by the blocking element and cannot slide through the third region;

the second adjacent connector element comprises a second projecting element adapted to fit into the second end of the cavity, the second projecting element including a second sliding portion having the third width, wherein the second sliding portion is adapted to fit into and slide within the second region, wherein the second sliding portion includes a second notch adapted to receive at least a second portion of the blocking element, wherein the second sliding portion is blocked by the blocking element and cannot slide through the third region.

2. The multi-compartment container system of claim 1, wherein:

the cup portion further comprises a first section and a second section; and the cup portion is adapted to move between an expanded state in which no part of the second section is inside the first section and a collapsed state in which at least a portion of the second section is inside the first section.

3. The multi-compartment container system of claim 2, wherein:

the cup portion further comprises a flexible section adapted to move between an extended condition and a compressed condition;

the cup portion is in the expanded state when the flexible section is in the extended condition; and the cup portion is in the collapsed state when the flexible section is in the compressed condition.

4. The multi-compartment container system of claim 2, wherein:

the cup portion further comprises a flexible section adapted to move between an extended condition and a bent condition;

the cup portion is in the expanded state when the flexible section is in the extended condition; and the cup portion is in the collapsed state when the flexible section is in the bent condition.

5. The multi-compartment container system of claim 1, wherein:

the cup portion further comprises a flexible section adapted to move between an extended condition and a compressed condition;

the cup portion is in an expanded state when the flexible section is in the extended condition; and the cup portion is in a collapsed state when the flexible section is in the compressed condition.

6. The multi-compartment container system of claim 5, wherein:

the frame includes a top surface;

the cup portion further comprises a top section and a bottom section;

the bottom section comprises a bottom surface;

the top surface and the bottom surface are separated by a first distance when the cup portion is in the expanded state; and the top surface and the bottom surface are separated by a second distance when the cup portion is in the collapsed state, wherein the second distance is less than one-half the first distance.

7. The multi-compartment container system of claim 1, wherein at least one of the cup portion, the frame portion, and the lid comprises silicone.

8. The multi-compartment container system of claim 1, wherein at least one of the cup portion, the frame portion, and the lid comprises glass microspheres.

9. The multi-compartment container system of claim 1, wherein the first mating element comprises a projecting element and the second mating element comprises a groove adapted to receive the projecting element.

10. The multi-compartment container system of claim 1, wherein the lid holds a utensil defined as one of a spork, a fork, a spoon, a knife, a straw, and chopsticks.

11. The multi-compartment container system of claim 1, wherein the lid further comprises a cover adapted to cover the chamber and enclose the utensil.

12. A multi-compartment container system comprising:

a first compartment comprising:

a first cup portion comprising a first volume adapted to hold a first food or first liquid;

a first frame portion joined to the first cup portion, the first frame portion surrounding a first top edge of the first cup portion, the first frame portion comprising:

a first connector element disposed on a first side of the first frame; and one or more first mating elements; and a first lid comprising:

one or more second mating elements adapted to engage with the one or more first mating elements of the first frame to form a first seal; and a first chamber adapted to hold a first utensil; and a second compartment connected to the first compartment, the second compartment comprising:

a second cup portion comprising a second volume adapted to hold a second food or second liquid;

a second frame portion joined to the second cup portion, the second frame portion surrounding a second top edge of the second cup portion, the second frame portion comprising:

a second connector element disposed on a second side of the second frame, the second connector element being connected to the first connector element of the first frame of the first compartment; and one or more third mating elements; and a second lid comprising:

one or more fourth mating elements adapted to engage with the one or more third mating elements of the second frame to form a second seal; and a second chamber adapted to hold a second utensil wherein:

the first connector element comprises a cavity comprising a first end, a second end, a first region proximate the first end, the first region having a first width, a second region proximate the second end, the second region having the first width, a third region having a second width smaller than the first width, the third region being disposed between the first and second regions, and a blocking element disposed in the third region that reduces a width of the cavity in the third region;

wherein the second connector element comprises a projecting element adapted to fit into the first end of the cavity, the first projecting element including a sliding portion having a third width smaller than the first width and larger than the second width, wherein the sliding portion is adapted to fit into and slide within the first region, wherein the sliding portion includes a notch adapted to receive at least a portion of the blocking element, wherein the sliding portion is blocked by the blocking element and cannot slide through the third region.

13. The multi-compartment container system of claim 12, wherein:

the first cup portion further comprises a first section and a second section; and the first cup portion is adapted to move between an expanded state in which no part of the second section is inside the first section and a collapsed state in which at least a portion of the second section is inside the first section.

14. The multi-compartment container system of claim 12, wherein at least one of the first cup portion, the first frame portion, and the first lid comprises silicone.

15. The multi-compartment container system of claim 12, wherein at least one of the first cup portion, the first frame portion, and the first lid comprises glass microspheres.

* * * * *